US009863697B2

(12) United States Patent
Roberts et al.

(10) Patent No.: US 9,863,697 B2
(45) Date of Patent: Jan. 9, 2018

(54) INTEGRATED METHANE REFRIGERATION SYSTEM FOR LIQUEFYING NATURAL GAS

(71) Applicant: AIR PRODUCTS AND CHEMICALS, INC., Allentown, PA (US)

(72) Inventors: Mark Julian Roberts, Kempton, PA (US); Yang Liu, Breinigsville, PA (US); Fei Chen, Whitehouse Station, NJ (US)

(73) Assignee: Air Products and Chemicals, Inc., Allentown, PA (US)

( * ) Notice: Subject to any disclaimer, the term of this patent is extended or adjusted under 35 U.S.C. 154(b) by 258 days.

(21) Appl. No.: 14/695,521

(22) Filed: Apr. 24, 2015

(65) Prior Publication Data

US 2016/0313057 A1 Oct. 27, 2016

(51) Int. Cl.
*F25J 1/02* (2006.01)
*F25J 1/00* (2006.01)

(52) U.S. Cl.
CPC ..... *F25J 1/0082* (2013.01); *F25J 1/004* (2013.01); *F25J 1/005* (2013.01); *F25J 1/0022* (2013.01); *F25J 1/0037* (2013.01); *F25J 1/0085* (2013.01); *F25J 1/0092* (2013.01); *F25J 1/021* (2013.01); *F25J 1/0202* (2013.01); *F25J 1/0208* (2013.01); *F25J 1/0263* (2013.01); *F25J 1/0267* (2013.01); *F25J 1/0278* (2013.01); *F25J 1/0288* (2013.01);

(Continued)

(58) Field of Classification Search
CPC F25J 1/0022; F25J 1/0037; F25J 1/004; F25J 1/005; F25J 1/0082
See application file for complete search history.

(56) References Cited

U.S. PATENT DOCUMENTS 2,959,020 A * 11/1960 Knapp ..... F25J 1/0007 62/47.1
3,616,652 A 11/1971 Engel
(Continued)

FOREIGN PATENT DOCUMENTS

| | | |
|---|---|---|
| WO | 2007110045 | 10/2007 |
| WO | 2013028363 | 2/2013 |
| WO | 2013191948 | 12/2013 |

OTHER PUBLICATIONS

U. Rathmann, et al, "Which Liquefaction Process Suits Best for LNG-Peakshaving Plants?", Cyrogenic Processes and Equipment Symposium, 1984, 7-18.

*Primary Examiner* — Frantz Jules
*Assistant Examiner* — Brian King
(74) *Attorney, Agent, or Firm* — Eric J. Schaal

(57) ABSTRACT

Described herein is a method and system for liquefying a natural gas feed stream to produce an LNG product. The natural gas feed stream is liquefied, by indirect heat exchange with a gaseous methane or natural gas refrigerant circulating in a gaseous expander cycle, to produce a first LNG stream. The first LNG stream is expanded, and the resulting vapor and liquid phases are separated to produce a first flash gas stream and a second LNG stream. The second LNG stream is then expanded, with the resulting vapor and liquid phases being separated to produce the second flash gas stream and a third LNG stream, all or a portion of which forms the LNG product. Refrigeration is recovered from the second flash gas by using said stream to sub-cool the second LNG stream or a supplementary LNG stream.

24 Claims, 10 Drawing Sheets

(52) U.S. Cl.
CPC ..... *F25J 1/0292* (2013.01); *F25J 2220/62* (2013.01); *F25J 2230/08* (2013.01); *F25J 2245/90* (2013.01); *F25J 2270/06* (2013.01); *F25J 2270/16* (2013.01)

(56) References Cited

U.S. PATENT DOCUMENTS

| | | | | |
|---|---|---|---|---|
| 4,225,329 | A | 9/1980 | Bailey et al. | |
| 4,778,497 | A | 10/1988 | Hanson et al. | |
| 4,921,514 | A | 5/1990 | Rowles et al. | |
| 6,412,302 | B1 | 7/2002 | Foglietta | |
| 6,564,578 | B1 * | 5/2003 | Fischer-Calderon .. | F25J 1/0022 62/613 |
| 6,658,890 | B1 | 12/2003 | Hahn et al. | |
| 6,763,680 | B2 * | 7/2004 | Fischer ..... | F25J 1/0022 62/612 |
| 7,225,636 | B2 | 6/2007 | Baudat | |
| 7,234,321 | B2 | 6/2007 | Maunder et al. | |
| 8,656,733 | B2 | 2/2014 | Roberts et al. | |
| 2004/0255616 | A1 | 12/2004 | Maunder et al. | |
| 2010/0154470 | A1 * | 6/2010 | Nilsen ..... | F25J 1/0022 62/613 |
| 2010/0263532 | A1 | 10/2010 | Thomas et al. | |
| 2014/0083132 | A1 | 3/2014 | Maunder et al. | |

* cited by examiner

INTEGRATED METHANE REFRIGERATION SYSTEM FOR LIQUEFYING NATURAL GAS

BACKGROUND

The present invention relates to a method and system for liquefying a natural gas feed stream to produce a liquefied natural gas (LNG) product.

The liquefaction of natural gas is a highly important industrial process. The worldwide production capacity for LNG is more than 300 MTPA, and a variety of refrigeration cycles for liquefying natural gas have been successfully developed, and are known and widely used in the art.

Some cycles utilize a vaporized or vaporizing refrigerant to provide the cooling duty for liquefying the natural gas. In these cycles, the initially gaseous, warm refrigerant (which may, for example, be a pure, single component refrigerant, or a mixed refrigerant) is compressed, cooled and liquefied to provide a liquid refrigerant. This liquid refrigerant is then expanded so as to produce a cold vaporized or vaporizing refrigerant that is used to liquefy the natural gas via indirect heat exchange between the refrigerant and natural gas. The resulting warmed vaporized refrigerant can then be compressed to start again the cycle. Exemplary cycles of this type that are known and used in the art include the single mixed refrigerant (SMR) cycle, cascade cycle, dual mixed refrigerant (DMR) cycle, and propane pre-cooled mixed refrigeration (C3MR) cycle.

Other cycles utilize a gaseous expansion cycle to provide the cooling duty for liquefying the natural gas. In these cycles, the gaseous warm refrigerant is compressed and cooled to form a compressed refrigerant. The compressed refrigerant is then expanded to further cool the refrigerant, resulting in an expanded cold refrigerant that is then used to liquefy the natural gas via indirect heat exchange between the refrigerant and natural gas. The resulting warmed expanded refrigerant can then be compressed to start again the cycle. An exemplary cycle of this type that is known and used in the art is the nitrogen expander cycle.

Further discussion of the established nitrogen expander cycle, cascade, SMR and C3MR processes and their use in liquefying natural gas can, for example, be found in "*Selecting a suitable process*", by J. C. Bronfenbrenner, M. Pillarella, and J. Solomon, *Review the process technology options available for the liquefaction of natural gas*, summer 09, LNGINDUSTRY.COM At present, all the plants for liquefying natural gas that have so far been constructed are built on land. An important trend for further growth in the LNG industry is to develop remote offshore gas fields, which will require a system for liquefying natural gas to be built on a floating platform. Designing and operating such a LNG plant on a floating platform poses, however, a number of challenges that need to be overcome. Motion on the floating platform is one of the main challenges. Conventional liquefaction processes that use mixed refrigerant (MR) involve two-phase flow at certain points of the refrigeration cycle, which may lead to reduced performance due to liquid-vapor maldistribution if employed on a floating platform. In addition, in any of the refrigeration cycles that employ a liquefied refrigerant, liquid sloshing will cause additional mechanical stresses.

Storage of an inventory of flammable components is another concern for many LNG plants that employ refrigeration cycles such as the SMR, cascade, DMR or C3MR processes, either because of the unavailability of such components, or because of safety considerations, such as would in particular be the case for a Floating LNG (FLNG) platform.

As a result, there is an increasing need for the development of a process for liquefying natural gas that involves minimal two-phase flow and requires a minimal flammable refrigerant inventory.

The nitrogen recycle expander process is, as noted above, a well-known process that uses gaseous nitrogen as refrigerant. This process eliminates the usage of mixed refrigerant, and hence it represents an attractive alternative for FLNG facilities and for land-based LNG facilities which require minimum hydrocarbon inventory. However, the nitrogen recycle expander process has a relatively lower efficiency and involves larger heat exchangers, compressors, expanders and pipe sizes. In addition, the process depends on the availability of relatively large quantities of pure nitrogen.

U.S. Pat. No. 8,656,733 teaches a liquefaction method and system in which a closed-loop gaseous expander cycle, using for example gaseous nitrogen as the refrigerant, is used to liquefy and sub-cool a feed stream, such as for example a natural gas feed stream. In the embodiment depicted in FIG. 5 of said document, the sub-cooled LNG product may be throttled using a valve or expanded in a hydraulic turbine so as to partially vaporize the stream, and the resulting flash gas may be cold compressed and warmed against the refrigerant in the refrigerant heat exchangers, or may be warmed in the sub-cooler heat exchanger against the LNG stream.

U.S. Pat. No. 6,412,302 teaches a process for producing LNG that uses dual gaseous expander cycles to cool, liquefy and sub-cool a natural gas stream. One expander cycle uses gaseous methane, ethane, or treated natural gas as the refrigerant, and the other expander cycle uses gaseous nitrogen. The LNG product may be expanded in a liquid expander, then treated in an N2 stripper, in order to provide a treated LNG stream.

U.S. Pat. No. 6,658,890 teaches a system and a method for liquefying natural gas in which a cascade cycle comprising a closed loop propane circuit, closed loop ethylene circuit, and open loop methane circuit are used to cool, liquefy and sub-cool a natural gas feed stream. The natural gas is cooled against the vaporizing propane refrigerant, and liquefied by heat exchange with the vaporizing ethylene refrigerant. The resulting LNG stream is then subcooled in a sub-cooler heat exchanger and further cooled by flashing the sub-cooled LNG stream in two consecutive end-flash stages, thereby providing two methane flash gas streams that are used as refrigerant in the sub-cooler heat exchanger. The LNG stream from the second end-flash stage is further sub-cooled in the sub-cooler heat exchanger, and then divided in a splitter to provide the LNG product stream and a liquid methane stream that is expanded and also returned to the sub-cooler heat exchanger as refrigerant. The warmed methane refrigerant streams exiting the sub-cooler heat exchanger are compressed and recycled to the natural gas feed stream.

U.S. Pat. No. 7,234,321 teaches a process for liquefying natural gas, in which the natural gas feed stream is pre-cooled in a series of pre-cooler heat exchangers against a vaporized mixed-refrigerant, and is then partially liquefied by being expanded in a liquefying expander. The partially liquefied natural gas stream is then separated to provide an LNG stream and a methane vapor stream, the vapor stream being returned to and warmed in the pre-cooler heat exchangers before being compressed and recycled to the natural gas feed stream. The LNG stream may be throttled and further separated to provide the LNG product, and a further methane vapor stream that is also returned to and warmed in the pre-cooler heat exchangers to provide a warmed fuel gas.

US 2014/0083132 teaches a similar process to that taught in U.S. Pat. No. 7,234,321. In the process taught in US 2014/0083132, however, a closed-loop mixed-refrigerant circuit is not used, the natural gas feed stream instead being pre-cooled using an open-loop gaseous methane expander cycle and the methane vapor stream that is separated from the natural gas feed stream after partial liquefaction of the natural gas feed stream in the liquefying expander.

U.S. Pat. No. 4,778,497 teaches a process for producing a liquid cryogen in which a feed gas (the cryogen) is liquefied using an open-loop gaseous expander cycle that uses the feed gas as the refrigerant. The liquefied cryogen is then sub-cooled in a sub-cooler heat exchanger that uses a flashed portion of the end-product as refrigerant. Exemplary feed gases that can be liquefied using the process include helium, hydrogen, atmospheric gases, hydrocarbon gases, and mixtures of the aforementioned gases, such as air or natural gas.

U.S. Pat. No. 3,616,652 teaches a process for liquefying natural gas in which an open-loop gaseous expander cycle is used to liquefy the natural gas. The liquefied natural gas is then flashed and separated to provide the LNG product and a flash gas that is used as the refrigerant in the gaseous expander cycle.

BRIEF SUMMARY

According to a first aspect of the present invention, there is provided a method of liquefying a natural gas feed stream to produce a liquefied natural gas (LNG) product, the method comprising:

(a) liquefying the natural gas feed stream, by indirect heat exchange with a methane or natural gas refrigerant circulating as gaseous refrigerant in a gaseous expander cycle, to produce a first LNG stream;

(b) expanding the first LNG stream to further cool and partially vaporize said stream, and separating the resulting vapor and liquid phases to produce a first flash gas stream and a second LNG stream;

(c) expanding the second LNG stream to further cool and partially vaporize said stream, and separating the resulting vapor and liquid phases to produce a second flash gas stream and a third LNG stream, the LNG product comprising the third LNG stream or a portion thereof; and (d) recovering refrigeration from the second flash gas stream by using said stream to sub-cool, by indirect heat exchange:

(i) at least a portion of the second LNG stream prior to said stream being expanded in step (c); and/or (ii) a first supplementary LNG stream, at least a portion of which is then expanded and separated to produce additional vapor and liquid for forming, respectively, the second flash gas stream and third LNG stream.

According to a second aspect of the present invention, there is provided a system for liquefying a natural gas feed stream to produce a liquefied natural gas (LNG) product, the system comprising:

a first liquefier heat exchanger arranged and operable to receive the natural gas feed stream and a methane or natural gas refrigerant, and to liquefy the natural gas feed stream, by indirect heat exchange with the methane or natural gas refrigerant, to produce a first LNG stream;

a refrigeration circuit arranged and operable to circulate the methane or natural gas refrigerant as gaseous refrigerant in a gaseous expander cycle, the refrigeration circuit being connected to the first liquefier heat exchanger so as to pass the circulating gaseous refrigerant through the first liquefier heat exchanger;

a pressure reduction device and phase separation vessel arranged and operable to receive the first LNG stream, expand the first LNG stream so as to further cool and partially vaporize said stream, and separate the resulting vapor and liquid phases to produce a first flash gas stream and a second LNG stream;

a pressure reduction device and phase separation vessel arranged and operable to receive the second LNG stream, expand the second LNG stream so as to further cool and partially vaporize said stream, and separate the resulting vapor and liquid phases to produce a second flash gas stream and a third LNG stream, the LNG product comprising the third LNG stream or a portion thereof; and a first sub-cooler heat exchanger arranged and operable to receive the second flash gas stream and recover refrigeration therefrom, the first sub-cooler heat exchanger being further arranged and operable to:

(i) receive and sub-cool, by indirect heat exchange with the second flash gas stream, at least a portion of the second LNG stream prior to said stream being received by the pressure reduction device arranged and operable to expand said stream; and/or (ii) receive and sub-cool, by indirect heat exchange with the second flash gas stream, a first supplementary LNG stream, prior to at least a portion of said stream being received by a pressure reduction device and phase separation vessel arranged and operable to expand and separate said at least a portion of the first supplementary LNG stream so to produce additional vapor and liquid for forming, respectively, the second flash gas stream and third LNG stream.

DETAILED DESCRIPTION

Figure 1:
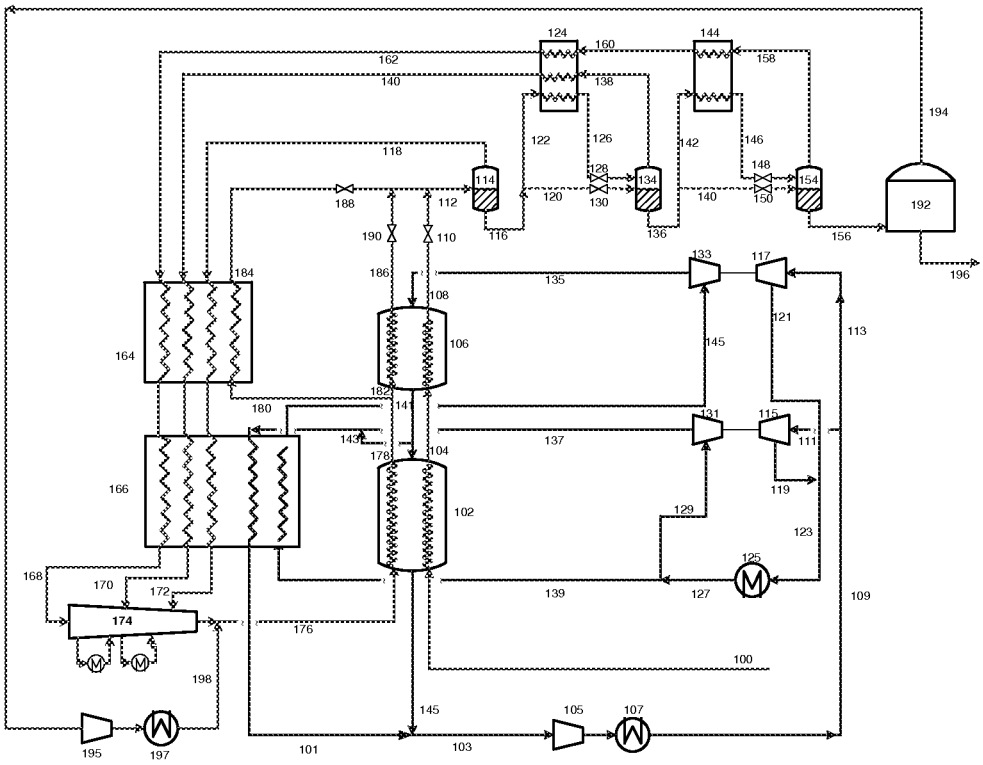
FIG. 1 is a schematic flow diagram depicting a natural gas liquefaction method and system in accordance with an embodiment the present invention.

The present invention provides methods and systems for liquefying a natural gas that are particularly suitable and attractive for Floating LNG (FLNG) applications and/or any other applications in which: two-phase flow of refrigerant can cause operational difficulties; maintenance of a large inventory of flammable refrigerant is problematic; large quantities of pure nitrogen or other required refrigerant components are unavailable or difficult to obtain; and/or the available footprint for the plant presents restrictions of the size of the heat exchangers, compressors, expanders and pipes that can be used in the refrigeration system.

In the present methods and systems, no external refrigerant for liquefaction and sub-cooling of the natural gas is needed, as all the cooling duty for liquefying and sub-cooling the natural gas can be provided by a methane or treated natural gas refrigerant and by end-stage flashing of the LNG. A single-phase gaseous expander cycle, employing a methane or natural gas refrigerant (and using, for example, one or two stages of expansion), is used to liquefy and, optionally, precool the natural gas. A multistage end flash system employing at least two flash stages (that are preferably in addition to any final LNG storage tank used to temporarily store the LNG product on site) is then used to provide refrigeration for sub-cooling.

Thus, the present methods and systems allow the usage of external refrigerants to be eliminated (or, alternatively, restricted to so that they are only used to provide precooling duty). As the refrigerant circulating in the refrigerant circuit that is used to provide the cooling duty for liquefying the natural gas remains entirely (or substantially entirely) in the gaseous phase as it circulates, problems associated with two-phase refrigerant flow in this circuit are avoided. Furthermore, the present liquefaction methods provide, as compared to the traditional nitrogen recycle process, better efficiency and smaller equipment and pipe sizes.

In particular, and as noted above, according to the first aspect of the present invention there is provided method of liquefying a natural gas feed stream to produce a liquefied natural gas (LNG) product, the method comprising steps (a), (b), (c) and (d), as described above.

As used herein and unless otherwise indicated, the articles "a" and "an" mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

In step (a) of the method, the natural gas feed stream is liquefied, by indirect heat exchange with a methane or natural gas refrigerant circulating as gaseous refrigerant in a gaseous expander cycle, so as to produce a first LNG stream. The first LNG streams may be formed from, and therefore comprise or consist of, all of the natural gas feed stream, or it may be formed from only a portion (preferably the majority) thereof, such as where another (preferably minor) portion of the LNG, generated by liquefying the natural gas feed stream by indirect heat exchange with the methane or natural gas refrigerant, is used to form one or more additional LNG streams, such as for example a supplementary LNG stream as may then be sub-cooled in step (d) of the method, as will be described in further detail below. Typically, the first LNG stream is produced at a temperature of between −130° C. and −90° C., inclusive.

As used herein, the term "natural gas feed stream" encompasses also streams comprising synthetic and/or substitute natural gases. The major component of natural gas is methane (which typically comprises at least 85 mole %, more often at least 90 mole %, and on average about 95 mole % of the feed stream). The natural gas feed stream typically also contains smaller amounts of other, heavier hydrocarbons, such as ethane, propane, butanes, pentanes, etc. Other typical components of raw natural gas include one or more components such as nitrogen, helium, hydrogen, carbon dioxide and/or other acid gases, and mercury. However, the natural gas feed stream processed in accordance with the present invention will have been pre-treated if and as necessary to reduce the levels of any (relatively) high freezing point components, such as moisture, acid gases, mercury and/or heavier hydrocarbons, down to such levels as are necessary to avoid freezing or other operational problems in the heat exchanger in which the natural gas feed stream is to be liquefied.

As used herein, the term "methane refrigerant" refers to a refrigerant that is predominantly or entirely methane. Typically it will comprise at least 90 mole % methane, and preferably at least 95 mole % methane.

As used herein, the term "natural gas refrigerant" refers to a refrigerant that is of similar or identical composition to the natural gas feed stream (and that will therefore typically also comprise at least 85 mole % methane). The natural gas refrigerant may have been treated so that, in comparison to the natural gas feed stream, the content in the refrigerant of some or all of the heavier hydrocarbons and/or other components heavier (i.e. having a lower volatility, or higher boiling point) than methane has been reduced, if this is necessary in order to avoid (or substantially avoid) any condensation of the natural gas refrigerant from occurring in the gaseous expander cycle.

As used herein, the term "indirect heat exchange" refers to heat exchange between two fluids where the two fluids are kept separate from each other by some form of physical barrier.

As used herein, the term "gaseous expander cycle" refers to a refrigeration cycle in which all, or at least substantially all, of gaseous refrigerant that is circulated to provide cooling duty remains in the gaseous phase at all points of the cycle. In the context of the present application, at least substantially all of gaseous refrigerant is to be considered as remaining in the gaseous phase if at least 95 mole % of the refrigerant that is circulating remains in the gaseous phase throughout the cycle. It is preferred that all of the refrigerant remains in the gaseous phase at all points of the cycle, but some minor amount of condensation may occur in practice, depending on the composition of the refrigerant and operating conditions used, and be tolerable if this does not have a appreciable adverse impact on the operation of the cycle or on the equipment.

The gaseous expander cycle typically comprises the steps of compressing a warmed expanded gaseous refrigerant, cooling the compressed gaseous refrigerant, expanding the cooled compressed gaseous refrigerant to form an expanded cold gaseous refrigerant, and warming the expanded cold gaseous refrigerant to provide the desired cooling duty (i.e. to provide cooling duty for liquefying a natural gas feed stream in the case of the present invention), thereby also forming again warmed expanded gaseous that is compressed to start again the cycle. Cooling of the circulating gaseous refrigerant typically takes place in one or more inter- or after-coolers associated with one or more compressors used to compress the refrigerant (which coolers may, for example, use an ambient heat sink, such as where ambient temperature air or water is used in the cooler to cool by indirect heat exchange the circulating gaseous refrigerant). Further cooling of the gaseous refrigerant may also take place in one or more heat exchangers in which one or more expanded streams of the circulating gaseous refrigerant are used to cool one or more compressed streams of the circulating gaseous refrigerant. Expansion of the circulating gaseous refrigerant typically takes place in one or more turbines (or other work expansion devices) that may, for example, also provide mechanical or electrical power, which may be used for driving the one or more compressors. The refrigerant circuit in which the gaseous expansion cycle takes place comprises, of course, the necessary compressors, coolers, expanders and heat exchangers.

In some embodiments of the invention, the method may use a methane or natural gas refrigerant circulating as gaseous refrigerant in a closed-loop gaseous expander cycle. As used herein, the terms "closed-loop cycle", "closed-loop circuit" and the like refer to a refrigeration cycle or circuit in which, during normal operation, refrigerant is not removed from the circuit or added to the circuit (other than to compensate for small unintentional losses such as through leakage or the like).

In other embodiments, the method may use a natural gas refrigerant circulating as gaseous refrigerant in an open-loop gaseous expander cycle. As used herein, the term "open-loop cycle", "open-loop circuit" and the like refer to a refrigerant cycle or circuit in which, during normal operation, refrigerant is added to and removed from the circuit on a continuous basis. Thus, for example, in the embodiments of the present invention that use a natural gas refrigerant circulating as gaseous refrigerant in an open-loop gaseous expander cycle, a natural gas stream may be introduced in the open-loop circuit as a combination of natural gas feed and make-up refrigerant, which natural gas stream is then combined with a recycled gaseous refrigerant stream. The combined stream may then be compressed and cooled to form a compressed and cooled gaseous stream that is then split to form the natural gas feed stream that is to be liquefied, and a stream of (cooled) gaseous refrigerant. The stream of cooled gaseous refrigerant may then be expanded to provide a cold expanded gaseous refrigerant stream that is warmed to liquefy the natural gas stream, and the warmed gaseous refrigerant may be recycled to start again the cycle.

In a preferred embodiment, the methane or natural gas refrigerant provides all of the cooling duty for liquefying the natural gas feed stream.

In another preferred embodiment, in which step (a) comprises liquefying the natural gas stream also by indirect heat exchange with at least a portion of one or more of the flash gas streams that are generated by the method (as will be described in further detail below), the methane or natural gas refrigerant and said at least a portion of one or more of the flash gas streams provide all of the cooling duty for liquefying the natural gas feed stream.

As used herein, the phrase "cooling duty for liquefying the natural gas feed stream" refers to the refrigeration required in order to convert the natural gas feed stream from a gaseous stream into a liquid stream. It does not refer to any cooling duty that may be required for pre-cooling the natural gas feed stream (e.g. lowering the temperature of the gaseous natural gas feed stream from ambient temperature) prior to liquefaction.

In some embodiments of the invention, the methane or natural gas refrigerant and/or at least a portion of one or more of the flash gas streams are also used to precool the natural gas feed stream, by indirect heat exchange between the natural gas feed stream and said refrigerant and/or flash gas. Said refrigerant and/or flash gas may provide all the cooling duty for precooling the natural gas feed stream.

Alternatively or additionally, another refrigerant circulating in a separate refrigeration circuit may be used to precool, by indirect heat exchange, the natural gas feed stream, and thus may be used to provide some or all of the cooling duty for precooling the natural gas feed stream. In one embodiment, an ethane and/or ethylene refrigerant circulating as gaseous refrigerant in a closed-loop gaseous expander cycle may be used to precool the natural gas feed stream. In yet other embodiments, yet other refrigerant cycles (such as, for example, a propane cycle, hydrofluorcarbon cycle, ammonia cycle, carbon dioxide, or Lithium Bromide absorption cycle) may be used to provide some or all of the cooling duty for precooling the natural gas feed stream. Said additional refrigerant cycle may also provide some or the all of the cooling duty for precooling the methane refrigerant stream.

The liquefaction of the natural gas feed stream may take place in any suitable form of heat exchanger, such as but not limited to a heat exchanger of the shell and tube, coil-wound, or plate and fin type. However, in a preferred embodiment the natural gas feed stream is liquefied in a coil-wound heat exchanger (which may, for example, comprise a single heat exchanger unit comprising a shell casing enclosing one or more tube bundles or sections, or may comprise more than one heat exchanger unit each having its own shell casing).

In step (b) of the method, the first LNG stream is expanded to further cool and partially vaporize said stream, and the resulting vapor and liquid phases are separated to produce a first flash gas stream and a second LNG stream. The first flash gas stream may be formed from, and therefore comprise or consist of, all of the vapor generated from expanding and separating the first LNG stream, or it may be formed from only a portion (but preferably at least the majority) thereof. Likewise, the second LNG stream may be formed from, and therefore comprise or consist of, all of the liquid generated from expanding and separating the first LNG stream, or it may be formed from only a portion (but preferably at least the majority) thereof.

As used herein the term "flash gas" refers to a gas or vapor obtained by expanding (also referred to herein as "flashing" or "flash evaporating") and thereby reducing the pressure of and partially vaporizing a liquid stream, and then separating the vapor phase. The liquid stream may expanded (or "flashed") by passing the stream through any pressure reduction device suitable for reducing the pressure of and thereby partially vaporizing the stream, such for example a J-T valve (or other throttling device) or a hydraulic turbine (or other work expansion device), although typically a valve or other such form of throttling device is preferably used.

In step (c) of the method, the second LNG stream is expanded to further cool and partially vaporize said stream, and the resulting vapor and liquid phases are separated to produce a second flash gas stream and a third LNG stream, the LNG product comprising the third LNG stream or a portion thereof. The second flash gas stream may be formed from, and therefore comprise or consist of, all of the vapor generated from expanding and separating the second LNG stream, or it may be formed from only a portion (but preferably at least the majority) thereof. Likewise, the third LNG stream may be formed from, and therefore comprise or consist of, all of the liquid generated from expanding and separating the second LNG stream, or it may be formed from only a portion (but preferably at least the majority) thereof.

In step (d) of the method, refrigeration is recovered from the second flash gas stream by using said stream to sub-cool, by indirect heat exchange, either or both of:

(i) at least a portion of the second LNG stream, prior to said stream being expanded in step (c); and (ii) a first supplementary LNG stream, at least a portion of which is then expanded and separated to produce additional vapor and liquid for forming, respectively, the second flash gas stream and third LNG stream.

In preferred embodiments, step (d) comprises sub-cooling at least a portion of the second LNG stream, by indirect heat exchange with the second flash gas stream, prior to said second LNG stream being expanded in step (c).

In those embodiments where step (d) comprises sub-cooling a first supplementary LNG stream by indirect heat exchange with the second flash gas stream, and expanding and separating at least a portion of the supplementary LNG stream to produce additional vapor and liquid for forming, respectively, the second flash gas stream and third LNG stream, the expanded and partially vaporized supplementary LNG stream (or portion thereof) may be combined with the expanded and partially vaporized second LNG stream, and the combined two-phase mixture separated into its constituent vapor and liquid phases in order to provide the second flash gas stream and third LNG stream. Alternatively, the separated vapor from the expanded and partially vaporized supplementary LNG stream (or portion thereof) may be combined with the separated vapor from the expanded and partially vaporized second LNG stream in order to provide the second flash gas stream, and the separated liquid from the expanded and partially vaporized supplementary LNG stream (or portion thereof) may be combined with the separated liquid from the expanded and partially vaporized second LNG stream in order to provide the third LNG stream.

In those embodiments where step (d) comprises sub-cooling a first supplementary LNG stream by indirect heat exchange with the second flash gas stream, the supplementary LNG stream may be derived from any suitable source. The supplementary LNG stream may, for example, comprise recycled flash gas that has been re-liquefied, as will be described in further detail below. Alternatively or additionally, the supplementary LNG stream may, as described above, comprise a portion of the LNG that is generated by liquefying the natural gas feed stream by indirect heat exchange with the methane or natural gas refrigerant and that is not used to form the first LNG stream.

In some embodiments the method may further comprise one or more additional flash stages, in which the third LNG stream is expanded and separated to provide further flash gas and LNG streams.

Thus, in one embodiment, the method further comprises:

(e) expanding the third LNG stream to further cool and partially vaporize said stream, and separating the resulting vapor and liquid phases to produce a third flash gas stream and a fourth LNG stream, the LNG product comprising the fourth LNG stream or a portion thereof; and (f) recovering refrigeration from the third flash gas stream by using said stream to sub-cool, by indirect heat exchange:

(i) at least a portion of the third LNG stream prior to said stream being expanded in step (e); and/or (ii) a second supplementary LNG stream, formed from a sub-cooled portion of the first supplementary LNG stream, at least a portion of which is then expanded and separated to produce additional vapor and liquid for forming, respectively, the third flash gas stream and fourth LNG stream.

In step (e), the third flash gas stream may be formed from, and therefore comprise or consist of, all of the vapor generated from expanding and separating the third LNG stream, or it may be formed from only a portion (but preferably at least the majority) thereof. Likewise, the fourth LNG stream may be formed from, and therefore comprise or consist of, all of the liquid generated from expanding and separating the third LNG stream, or it may be formed from only a portion (but preferably at least the majority) thereof.

In a preferred embodiment, step (f) comprises sub-cooling at least a portion of the third LNG stream, by indirect heat exchange with the third flash gas stream, prior to said third LNG stream being expanded in step (e).

In a preferred embodiment, step (d) comprises sub-cooling the at least a portion of the second LNG stream and/or the first supplementary LNG stream by indirect heat exchange with both the second flash gas stream and the third flash gas stream (the third flash gas stream in this case already having been warmed in step (f), by indirect heat exchange with the third LNG stream or second supplementary LNG stream, before being further warmed in step (d), by indirect heat exchange with the second LNG stream and/or the first supplementary LNG stream).

In preferred embodiments, at least a portion of one or more, or all, of the flash gas streams (e.g. at least a portion of one or more, or all, of the first, second and/or third flash gas streams) are recycled so as to provide additional LNG product. This may be achieved in a number of different ways.

In one embodiment, the method may further comprise recycling at least a portion of one or more of the flash gas streams by: compressing said at least a portion of the flash gas stream(s) so as to form one or more recycle gas streams; and liquefying one or more of said one or more recycle gas streams to produce one or more liquefied recycle streams.

The recycle gas stream(s) are, preferably, liquefied: by indirect heat exchange with the methane or natural gas refrigerant circulating as gaseous refrigerant in the gaseous expander cycle; and/or by indirect heat exchange with at least a portion of one or more of the flash gas streams. Preferably, the methane or natural gas refrigerant and/or at least a portion of one or more of the flash gas streams provide all of the cooling duty for liquefying the recycle gas stream(s).

The method may then further comprise expanding and separating one or more of said one or more liquefied recycle streams to produce additional vapor and liquid for forming, respectively, the first flash gas stream and second LNG stream.

Alternatively or additionally, the method may then further comprise expanding one or more of said one or more liquefied recycle gas streams, introducing the expanded recycle gas stream(s) into a distillation column to be separated into a nitrogen-enriched overhead vapor and nitrogen-depleted bottoms liquid, withdrawing a stream of the nitrogen depleted bottoms liquid from the distillation column, and expanding and separating said stream of bottoms liquid to produce additional vapor and liquid for forming, respectively, the first flash gas stream and second LNG stream.

Alternatively or additionally, in those embodiments where step (d) comprises sub-cooling, expanding and separating a first supplementary LNG stream, the first supplementary LNG stream may comprise or consist of one or more of said one or more liquefied recycle streams.

In another embodiment, the method may further comprise recycling at least a portion of one or more of the flash gas streams by: compressing the flash gas stream(s) or portion(s) thereof so as to form one or more recycle gas streams; and introducing one or more of said one or more recycle gas streams into the natural gas feed stream prior to the natural gas feed stream being liquefied in step (a).

In some embodiments of the invention, refrigeration may be recovered from at least a portion of one or more of the flash gas streams by using said flash gas to cool one or more other process streams. For example, in one embodiment of the invention, at least a portion of methane or natural gas refrigerant circulating as gaseous refrigerant in the gaseous expander cycle is cooled, prior to being expanded to form cold gaseous refrigerant that is used in step (a) for liquefying the natural gas feed stream, by indirect heat exchange with at least a portion of one or more of the flash gas streams.

As noted above, according to the second aspect of the present invention there is provided system for liquefying a natural gas feed stream to produce a liquefied natural gas (LNG) product, the system comprising:

a first liquefier heat exchanger arranged and operable to receive the natural gas feed stream and a methane or natural gas refrigerant, and to liquefy the natural gas feed stream, by indirect heat exchange with the methane or natural gas refrigerant, to produce a first LNG stream;

a refrigeration circuit arranged and operable to circulate the methane or natural gas refrigerant as gaseous refrigerant in a gaseous expander cycle, the refrigeration circuit being connected to the first liquefier heat exchanger so as to pass the circulating gaseous refrigerant through the first liquefier heat exchanger;

a pressure reduction device and phase separation vessel arranged and operable to receive the first LNG stream, expand the first LNG stream so as to further cool and partially vaporize said stream, and separate the resulting vapor and liquid phases to produce a first flash gas stream and a second LNG stream;

a pressure reduction device and phase separation vessel arranged and operable to receive the second LNG stream, expand the second LNG stream so as to further cool and partially vaporize said stream, and separate the resulting vapor and liquid phases to produce a second flash gas stream and a third LNG stream, the LNG product comprising the third LNG stream or a portion thereof; and a first sub-cooler heat exchanger arranged and operable to receive the second flash gas stream and recover refrigeration therefrom, the first sub-cooler heat exchanger being further arranged and operable to:

(i) receive and sub-cool, by indirect heat exchange with the second flash gas stream, at least a portion of the second LNG stream prior to said stream being received by the pressure reduction device arranged and operable to expand said stream; and/or (ii) receive and sub-cool, by indirect heat exchange with the second flash gas stream, a first supplementary LNG stream, prior to at least a portion of said stream being received by a pressure reduction device and phase separation vessel arranged and operable to expand and separate said at least a portion of the first supplementary LNG stream so to produce additional vapor and liquid for forming, respectively, the second flash gas stream and third LNG stream.

The system according to the second aspect of the present invention is suitable for carrying out the methods of the first aspect, and therefore the above-mentioned benefits of the method according to the first aspect of the invention apply equally to the systems according to the second aspect of the invention.

As noted above, the pressure reduction device may be any device suitable for reducing the pressure of and thereby partially vaporizing the stream, such for example one or more J-T valves (or other throttling device(s)) or hydraulic turbines (or other work expansion device(s)), although typically a valve or other such form of throttling device is preferably used.

As used herein, the term "separator" or "phase separator" refers to a device, such as drum or other form of vessel, into which a two phase stream can be introduced in order to separate the stream into its constituent vapor and liquid phases. Where both a valve (or other such throttling device) and separator are being used, the two may be combined into a single device, such as for example a flash drum in which the inlet(s) to the drum include one or more devices suitable for reducing the pressure of, and thereby flashing, the stream(s) being introduced into the drum.

The refrigeration circuit arranged and operable to circulate the methane or natural gas refrigerant may be a closed-loop circuit, or an open-loop circuit.

In a preferred embodiment, the first sub-cooler heat exchanger is arranged and operable to receive the second flash gas stream and at least a portion of the second LNG stream, and to sub-cool said at least a portion of the second LNG stream, by indirect heat exchange with the second flash gas stream, prior to said second LNG stream being received by the pressure reduction device arranged and operable to expand said stream.

As noted above, the first liquefier heat exchanger may be any suitable form of heat exchanger, such as but not limited to a heat exchanger of the shell and tube, coil-wound, or plate and fin type. However, in a preferred embodiment the first liquefier heat exchanger is a coil-wound heat exchanger (which may, for example, comprise a single heat exchanger unit comprising a shell casing enclosing one or more tube bundles or sections, or may comprise more than one heat exchanger unit each having its own shell casing).

In a preferred embodiment, the first liquefier heat exchanger is arranged such that in operation the only refrigerant that it receives is either the methane or natural gas refrigerant, or the methane or natural gas refrigerant and the at least a portion of one or more of the flash gas streams, so that in operation the methane or natural gas refrigerant, or the methane or natural gas refrigerant and the at least a portion of one or more of the flash gas streams, provides all of the cooling duty for liquefying the natural gas feed stream.

In one embodiment, the system further comprises a pressure reduction device and phase separation vessel arranged and operable to receive the third LNG stream, expand the third LNG stream so as to further cool and partially vaporize said stream, and separate the resulting vapor and liquid phases to produce a third flash gas stream and a fourth LNG stream, the LNG product comprising the fourth LNG stream or a portion thereof; and a second sub-cooler heat exchanger arranged and operable to receive the third flash gas stream and recover refrigeration therefrom, the second sub-cooler heat exchanger being further arranged and operable to:

(i) receive and sub-cool, by indirect heat exchange with the third flash gas stream, at least a portion of the third LNG stream prior to said stream being received by the pressure reduction device arranged and operable to expand said stream; and/or (ii) receive and sub-cool, by indirect heat exchange with the second flash gas stream, a second supplementary LNG stream, formed from a sub-cooled portion of the first supplementary LNG stream, prior to at least a portion of said second supplementary LNG stream being received by a pressure reduction device and phase separation vessel arranged and operable to expand and separate said at least a portion of the second supplementary LNG stream so to produce additional vapor and liquid for forming, respectively, the third flash gas stream and fourth LNG stream.

Preferably, the second sub-cooler heat exchanger is arranged and operable to receive the third flash gas stream and at least a portion of the third LNG stream, and to sub-cool said at least a portion of the third LNG stream, by indirect heat exchange with the third flash gas stream, prior to said third LNG stream being received by the pressure reduction device arranged and operable to expand said stream.

Preferably, the first sub-cooler heat exchanger is arranged and operable to receive also the third flash gas stream and to sub-cool the at least a portion of the second LNG stream and/or the first supplementary LNG stream by indirect heat exchange with both the second flash gas stream and the third flash gas stream.

In one embodiment, the system further comprises one or more compressors arranged and operable to receive and compress at least a portion of one or more of the flash gas streams, so as to form one or more recycle gas streams.

The system may further comprise a second liquefier heat exchanger arranged and operable to receive one or more of said one or more recycle gas streams, to receive the methane or natural gas refrigerant and/or at least a portion of one or more of the flash gas streams, and to and liquefy said recycle gas stream(s) by indirect heat exchange with said methane or natural gas refrigerant and/or said flash gas. The second liquefier heat exchanger may be arranged such that in operation the only refrigerant that it receives is the methane or natural gas refrigerant and/or the at least a portion of one or more of the flash gas streams, so that in operation said methane or natural gas refrigerant and/or said flash gas provides all of the cooling duty for liquefying said recycle gas stream(s).

Alternatively or additionally, the first liquefier heat exchanger may be arranged and operable to receive one or more of said one or more recycle gas streams, and to liquefy said stream(s) by indirect heat exchange with the methane or natural gas refrigerant.

The system may further comprise one or more pressure reduction devices arranged and operable to receive and expand one or more of said one or more liquefied recycle gas streams, so as to cool and partially vaporize said stream(s), and to deliver said expanded recycle gas stream(s) into the phase separation vessel that receives and separates the expanded first LNG stream.

The system may further comprise: one or more pressure reduction devices arranged and operable to receive and expand one or more of said one or more liquefied recycle gas streams, so as to further cool and partially vaporize said stream(s); a distillation column arranged and operable to receive said expanded recycle gas stream(s) and separate said stream(s) into a nitrogen-enriched overhead vapor and nitrogen-depleted bottoms liquid; and a pressure reduction device arranged and operable to receive and expand a stream of nitrogen depleted bottoms liquid withdrawn from the distillation column, so as to further cool and partially vaporize said stream, and to deliver said expanded bottoms liquid stream into the phase separation vessel that receives and separates the expanded first LNG stream.

As is well known in the art, the term "distillation column" refers to a column containing one or more separation stages, each composed a device such as packing or a tray, that increase contact and thus enhance mass transfer between upward rising vapor and downward flowing liquid flowing inside the column. In this way, the concentration of lighter (i.e. higher volatility and lower boiling point) components is increased in the rising vapor that collects as overhead vapor at the top of the column, and the concentration of heavier (i.e. lower volatility and higher boiling point) components is increased in the bottoms liquid that collects at the bottom of the column. The "top" of the distillation column refers to the part of the column at or above the top-most separation stage. The "bottom" of the column refers to the part of the column at or below the bottom-most separation stage. An "intermediate location" of the column refers to a location between the top and bottom of the column, between two separation stages.

Where the first sub-cooler heat exchanger is be arranged and operable receive and sub-cool a first supplementary LNG stream, the first supplementary LNG stream may comprise one or more of the one or more liquefied recycle streams.

The one or more compressors that are arranged and operable to compress at least a portion of one or more of the flash gas streams may, furthermore, be arranged and operable to introduce one or more of the one or more recycle gas streams into the natural gas feed stream prior to the natural gas feed stream being received by the first liquefier heat exchanger.

Further embodiments of the system according to the second aspect will be apparent from the foregoing discussion of embodiments of the method according to the first aspect.

Preferred aspects of the present invention include the following aspects, numbered #1 to #32:

#1. A method of liquefying a natural gas feed stream to produce a liquefied natural gas (LNG) product, the method comprising:

(a) liquefying the natural gas feed stream, by indirect heat exchange with a methane or natural gas refrigerant circulating as gaseous refrigerant in a gaseous expander cycle, to produce a first LNG stream;

(b) expanding the first LNG stream to further cool and partially vaporize said stream, and separating the resulting vapor and liquid phases to produce a first flash gas stream and a second LNG stream;

(c) expanding the second LNG stream to further cool and partially vaporize said stream, and separating the resulting vapor and liquid phases to produce a second flash gas stream and a third LNG stream, the LNG product comprising the third LNG stream or a portion thereof; and (d) recovering refrigeration from the second flash gas stream by using said stream to sub-cool, by indirect heat exchange:

(i) at least a portion of the second LNG stream prior to said stream being expanded in step (c); and/or (ii) a first supplementary LNG stream, at least a portion of which is then expanded and separated to produce additional vapor and liquid for forming, respectively, the second flash gas stream and third LNG stream.

#2. The method of Aspect #1, wherein step (d) comprises sub-cooling at least a portion of the second LNG stream, by indirect heat exchange with the second flash gas stream, prior to said second LNG stream being expanded in step (c).

#3. The method of Aspect #1 or #2, wherein either: the methane or natural gas refrigerant provides all of the cooling duty for liquefying the natural gas feed stream; or step (a) comprises liquefying the natural gas stream also by indirect heat exchange with at least a portion of one or more of the flash gas streams, and the methane or natural gas refrigerant and at least a portion of one or more of the flash gas streams provide all of the cooling duty for liquefying the natural gas feed stream.

#4. The method of any one of Aspects #1 to #3, wherein the method further comprises:

(e) expanding the third LNG stream to further cool and partially vaporize said stream, and separating the resulting vapor and liquid phases to produce a third flash gas stream and a fourth LNG stream, the LNG product comprising the fourth LNG stream or a portion thereof; and (f) recovering refrigeration from the third flash gas stream by using said stream to sub-cool, by indirect heat exchange:

(i) at least a portion of the third LNG stream prior to said stream being expanded in step (e); and/or (ii) a second supplementary LNG stream, formed from a sub-cooled portion of the first supplementary LNG stream, at least a portion of which is then expanded and separated to produce additional vapor and liquid for forming, respectively, the third flash gas stream and fourth LNG stream.

#5. The method of Aspect #4, wherein step (f) comprises sub-cooling at least a portion of the third LNG stream, by indirect heat exchange with the third flash gas stream, prior to said third LNG stream being expanded in step (e).

#6. The method of Aspect #4 or #5, wherein step (d) comprises sub-cooling the at least a portion of the second LNG stream and/or the first supplementary LNG stream by indirect heat exchange with both the second flash gas stream and the third flash gas stream.

#7. The method of any one of Aspects #1 to #6, wherein the method further comprises recycling at least a portion of one or more of the flash gas streams by:

compressing said at least a portion of the flash gas stream(s) so as to form one or more recycle gas streams; and liquefying one or more of said one or more recycle gas streams to produce one or more liquefied recycle streams.

#8. The method of Aspect #7, wherein the recycle gas stream(s) are liquefied: by indirect heat exchange with the methane or natural gas refrigerant circulating as gaseous refrigerant in a gaseous expander cycle; and/or by indirect heat exchange with at least a portion of one or more of the flash gas streams.

#9. The method of Aspect #8, wherein the methane or natural gas refrigerant and/or at least a portion of one or more of the flash gas streams provide all of the cooling duty for liquefying the recycle gas stream(s).

#10. The method of any one of Aspects #7 to #9, wherein the method further comprises expanding and separating one or more of said one or more liquefied recycle streams to produce additional vapor and liquid for forming, respectively, the first flash gas stream and second LNG stream.

#11. The method of any one of Aspects #7 to #10, wherein the method further comprises expanding one or more of said one or more liquefied recycle gas streams, introducing the expanded recycle gas stream(s) into a distillation column to be separated into a nitrogen-enriched overhead vapor and nitrogen-depleted bottoms liquid, withdrawing a stream of the nitrogen depleted bottoms liquid from the distillation column, and expanding and separating said stream of bottoms liquid to produce additional vapor and liquid for forming, respectively, the first flash gas stream and second LNG stream.

#12. The method of any one of Aspects #7 to #11, wherein step (d) comprises sub-cooling, expanding and separating a first supplementary LNG stream in accordance with step (d)(ii), and wherein the first supplementary LNG stream comprises one or more of said one or more liquefied recycle streams.

#13. The method of any one of Aspects #1 to #9, wherein the method further comprises recycling at least a portion of one or more of the flash gas streams by:

compressing the flash gas stream(s) or portion(s) thereof so as to form one or more recycle gas streams; and introducing one or more of said one or more recycle gas streams into the natural gas feed stream prior to the natural gas feed stream being liquefied in step (a).

#14. The method of any one of Aspects #1 to #13, wherein at least a portion of methane or natural gas refrigerant circulating as gaseous refrigerant in the gaseous expander cycle is cooled, prior to being expanded to form cold gaseous refrigerant that is used in step (a) for liquefying the natural gas feed stream, by indirect heat exchange with at least a portion of one or more of the flash gas streams.

#15. The method of any one of Aspects #1 to #14, wherein the methane or natural gas refrigerant circulates as gaseous refrigerant in a closed-loop gaseous expander cycle.

#16. The method of any one of Aspects #1 to #14, wherein the method uses a natural gas refrigerant circulating as gaseous refrigerant in an open-loop gaseous expander cycle.

#17. A system for liquefying a natural gas feed stream to produce a liquefied natural gas (LNG) product, the system comprising:

a first liquefier heat exchanger arranged and operable to receive the natural gas feed stream and a methane or natural gas refrigerant, and to liquefy the natural gas feed stream, by indirect heat exchange with the methane or natural gas refrigerant, to produce a first LNG stream;

a refrigeration circuit arranged and operable to circulate the methane or natural gas refrigerant as gaseous refrigerant in a gaseous expander cycle, the refrigeration circuit being connected to the first liquefier heat exchanger so as to pass the circulating gaseous refrigerant through the first liquefier heat exchanger;

a pressure reduction device and phase separation vessel arranged and operable to receive the first LNG stream, expand the first LNG stream so as to further cool and partially vaporize said stream, and separate the resulting vapor and liquid phases to produce a first flash gas stream and a second LNG stream;

a pressure reduction device and phase separation vessel arranged and operable to receive the second LNG stream, expand the second LNG stream so as to further cool and partially vaporize said stream, and separate the resulting vapor and liquid phases to produce a second flash gas stream and a third LNG stream, the LNG product comprising the third LNG stream or a portion thereof; and a first sub-cooler heat exchanger arranged and operable to receive the second flash gas stream and recover refrigeration therefrom, the first sub-cooler heat exchanger being further arranged and operable to:

(i) receive and sub-cool, by indirect heat exchange with the second flash gas stream, at least a portion of the second LNG stream prior to said stream being received by the pressure reduction device arranged and operable to expand said stream; and/or (ii) receive and sub-cool, by indirect heat exchange with the second flash gas stream, a first supplementary LNG stream, prior to at least a portion of said stream being received by a pressure reduction device and phase separation vessel arranged and operable to expand and separate said at least a portion of the first supplementary LNG stream so to produce additional vapor and liquid for forming, respectively, the second flash gas stream and third LNG stream.

#18. A system according to Aspect #17, wherein the first sub-cooler heat exchanger is arranged and operable to receive the second flash gas stream and at least a portion of the second LNG stream, and to sub-cool said at least a portion of the second LNG stream, by indirect heat exchange with the second flash gas stream, prior to said second LNG stream being received by the pressure reduction device arranged and operable to expand said stream.

#19. A system according to Aspect #17 or #18, wherein the first liquefier heat exchanger is arranged such that in operation the only refrigerant that it receives is either the methane or natural gas refrigerant, or the methane or natural gas refrigerant and the at least a portion of one or more of the flash gas streams, so that in operation the methane or natural gas refrigerant, or the methane or natural gas refrigerant and the at least a portion of one or more of the flash gas streams, provides all of the cooling duty for liquefying the natural gas feed stream.

#20. A system according to any one of Aspects #17 to #19, wherein the system further comprises:

a pressure reduction device and phase separation vessel arranged and operable to receive the third LNG stream, expand the third LNG stream so as to further cool and partially vaporize said stream, and separate the resulting vapor and liquid phases to produce a third flash gas stream and a fourth LNG stream, the LNG product comprising the fourth LNG stream or a portion thereof; and a second sub-cooler heat exchanger arranged and operable to receive the third flash gas stream and recover refrigeration therefrom, the second sub-cooler heat exchanger being further arranged and operable to:

(i) receive and sub-cool, by indirect heat exchange with the third flash gas stream, at least a portion of the third LNG stream prior to said stream being received by the pressure reduction device arranged and operable to expand said stream; and/or (ii) receive and sub-cool, by indirect heat exchange with the second flash gas stream, a second supplementary LNG stream, formed from a sub-cooled portion of the first supplementary LNG stream, prior to at least a portion of said second supplementary LNG stream being received by a pressure reduction device and phase separation vessel arranged and operable to expand and separate said at least a portion of the second supplementary LNG stream so to produce additional vapor and liquid for forming, respectively, the third flash gas stream and fourth LNG stream.

#21. A system according to Aspect #20, wherein the second sub-cooler heat exchanger is arranged and operable to receive the third flash gas stream and at least a portion of the third LNG stream, and to sub-cool said at least a portion of the third LNG stream, by indirect heat exchange with the third flash gas stream, prior to said third LNG stream being received by the pressure reduction device arranged and operable to expand said stream.

#22. A system according to Aspect #20 or #21, wherein the first sub-cooler heat exchanger is arranged and operable to receive also the third flash gas stream and to sub-cool the at least a portion of the second LNG stream and/or the first supplementary LNG stream by indirect heat exchange with both the second flash gas stream and the third flash gas stream.

#23. A system according to any one of Aspects #17 to #22, wherein the system further comprises one or more compressors arranged and operable to receive and compress at least a portion of one or more of the flash gas streams, so as to form one or more recycle gas streams.

#24. A system according to Aspect #23, wherein the system further comprises a second liquefier heat exchanger arranged and operable to receive one or more of said one or more recycle gas streams, to receive the methane or natural gas refrigerant and/or at least a portion of one or more of the flash gas streams, and to and liquefy said recycle gas stream(s) by indirect heat exchange with said methane or natural gas refrigerant and/or said flash gas.

#25. A system according to Aspect #24, wherein the second liquefier heat exchanger is arranged such that in operation the only refrigerant that it receives is the methane or natural gas refrigerant and/or the at least a portion of one or more of the flash gas streams, so that in operation said methane or natural gas refrigerant and/or said flash gas provides all of the cooling duty for liquefying said recycle gas stream(s).

#26. A system according to any one of Aspects #23 to #25, wherein the first liquefier heat exchanger is arranged and operable to receive one or more of said one or more recycle gas streams, and to liquefy said stream(s) by indirect heat exchange with the methane or natural gas refrigerant.

#27. A system according to any one of Aspects #24 to #26, wherein the system further comprises one or more pressure reduction devices arranged and operable to receive and expand one or more of said one or more liquefied recycle gas streams, so as to cool and partially vaporize said stream(s), and to deliver said expanded recycle gas stream(s) into the phase separation vessel that receives and separates the expanded first LNG stream.

#28. A system according to any one of Aspects #24 to #27, wherein the system further comprises: one or more pressure reduction devices arranged and operable to receive and expand one or more of said one or more liquefied recycle gas streams, so as to further cool and partially vaporize said stream(s); a distillation column arranged and operable to receive said expanded recycle gas stream (s) and separate said stream(s) into a nitrogen-enriched overhead vapor and nitrogen-depleted bottoms liquid; and a pressure reduction device arranged and operable to receive and expand a stream of nitrogen depleted bottoms liquid withdrawn from the distillation column, so as to further cool and partially vaporize said stream, and to deliver said expanded bottoms liquid stream into the phase separation vessel that receives and separates the expanded first LNG stream.

#29. A system according to any one of Aspects #24 to #28, wherein the first sub-cooler heat exchanger is arranged and operable receive and sub-cool a first supplementary LNG stream, and wherein the first supplementary LNG stream comprises one or more of said one or more liquefied recycle streams.

#30. A system according to any one of Aspects #23 to #29, wherein the one or more compressors that are arranged and operable to compress at least a portion of one or more of the flash gas streams are furthermore arranged and operable to introduce one or more of the one or more recycle gas streams into the natural gas feed stream prior to the natural gas feed stream being received by the first liquefier heat exchanger.

#31. A system according to any one of Aspects #17 to #30, wherein the refrigeration circuit arranged and operable to circulate the methane or natural gas refrigerant is a closed-loop circuit.

#32. A system according to any one of Aspects #17 to #30, wherein the refrigeration circuit arranged and operable to circulate the methane or natural gas refrigerant is an open-loop circuit.

Solely by way of example, certain preferred embodiment of the invention will now be described with reference to FIGS. 1 to 8. In these Figures, where a feature is common to more than one Figure that feature has been assigned the same reference numeral in each Figure, for clarity and brevity.

Referring now to FIG. 1, a natural gas liquefaction method and system in accordance with a first embodiment the present invention is shown. A pretreated clean natural gas feed stream 100 is first precooled in a first precooler heat exchanger 102, preferably to a temperature between −50° C. and −30° C., inclusive. The pretreatment (not shown) of the natural gas feed stream may involve the removal of components of the raw natural gas that would freeze during liquefaction and/or that are not desired in the final LNG product, and thus may involve one or more of dehydration, acid-gas removal, mercury removal and heavy hydrocarbon removal, as and where necessary. Depending on the pressure at which the natural gas is obtained, pretreatment may also involve compression of the natural gas.

The cooled natural gas feed stream 104 exiting the first precooler heat exchanger 102 is then further cooled and liquefied in a first liquefier heat exchanger 106 so as to produce a first LNG stream 108, preferably at a temperature of between −130° C. and −90° C., inclusive.

The first precooler heat exchanger 102 and first liquefier heat exchanger 106 can be any type, but preferably are coil wound heat exchanges (CWHE) as depicted in FIG. 1, because the CWHE double-contains hydrocarbons in the high pressure feed circuit and thus mitigates the risk of leaking flammable gases. It is also more tolerant to potential freeze-out of impurities in the feed stream. In the arrangement shown in FIG. 1, the first precooler heat exchanger 102 and first liquefier heat exchanger 106 are shown as being separate units, each comprising a single tuble bundle housed in its own shell casing. However, the first precooler heat exchanger 102 and first liquefier heat exchanger 106 could equally be combined so that they instead comprise the warm and cold sections, respectively, of a single heat exchanger unit. For example, the first precooler heat exchanger 102 and first liquefier heat exchanger 106 could comprise the warm and cold tube bundles, respectively, of a single CWHE unit, housed in the same shell casing.

The first LNG stream 108 is then subjected to three consecutive stages of flash in order to provide additional cooling, thereby generating three flash gas streams, 118, 138 and 158, of increasingly cold temperature, and an LNG product 156 at the desired low temperature.

More specifically, in the first flash stage, the first LNG stream 108 is expanded to further cool (lower the temperature of) and partially vaporize the stream, and the resulting vapor and liquid phases are separated to produce a first flash gas stream 118 and a second LNG stream 116. In the depicted embodiment, the first LNG stream 108 is expanded and separated by throttling the stream into a first phase separation vessel 114, the stream being throttled by passing the stream through a J-T valve 110. However, any suitable form of expansion device and could be used in place of the J-T valve 110 (and/or in place of any of the other J-T valves shown in the Figures).

At least a portion 122 of the second LNG stream 116 is next sub-cooled, in a first sub-cooler heat exchanger 124, and the resulting sub-cooled second LNG stream or portion of the second LNG stream 126 is then transferred to the second flash stage. All of the second LNG stream 116 may be sub-cooled in the first sub-cooler heat exchanger 124. Alternatively, a portion 120 of the second LNG stream 116 may bypass the first sub-cooler heat exchanger 124 and be transferred directly to the second flash stage.

In the second flash stage, the second LNG stream 116 is expanded to further cool and partially vaporize the stream, and the resulting vapor and liquid phases are separated to produce a second flash gas stream 138 and a third LNG stream 136. In the depicted embodiment, the second LNG stream 116 is expanded and separated by throttling the stream into a second phase separation vessel 134, the sub-cooled second LNG stream or portion of the second LNG stream 126 being throttled by passing said stream or portion through J-T valve 128, and any portion 120 of the second LNG stream 116 that has bypassed the first sub-cooler heat exchanger 124 being throttled by passing said portion through J-T valve 130.

At least a portion 142 of the third LNG stream 136 is next sub-cooled, in a second sub-cooler heat exchanger 144, and the resulting sub-cooled third LNG stream or portion of the third LNG stream 146 is then transferred to the third flash stage. All of the third LNG stream 136 may be sub-cooled in the second sub-cooler heat exchanger 144. Alternatively, a portion 140 of the third LNG stream 136 may bypass the second sub-cooler heat exchanger 144 and be transferred directly to the third flash stage.

In the third flash stage, the third LNG stream 136 is expanded to further cool and partially vaporize the stream, and the resulting vapor and liquid phases are separated to produce a third flash gas stream 158 and a fourth LNG stream 156 that, is this embodiment, constitutes the desired LNG product 156. In the depicted embodiment, the third LNG stream 136 is expanded and separated by throttling the stream into a third phase separation vessel 154, the sub-cooled third LNG stream or portion of the third LNG stream 146 being throttled by passing said stream or portion through J-T valve 148, and any portion 140 of the second LNG stream 136 that has bypassed the second sub-cooler heat exchanger 144 being throttled by passing said portion through J-T valve 150.

The fourth LNG stream 156, constituting the desired LNG product, may then be transferred directly to a pipeline or storage vessel for delivery off-site. Alternatively, as shown in FIG. 1, the LNG product may temporarily be stored on-site in an LNG storage tank 192, with LNG product 196 being withdrawn from the storage tank as and when required. In yet another embodiment, the third phase separation vessel 154 could be sized to function and operate as a storage tank, so that a separate LNG storage tank 192 is no longer needed.

As shown in FIG. 1, refrigeration is in this embodiment recovered from the second flash gas stream 138 and third flash gas stream 158 by passing the second flash gas stream 138 through and warming said stream in the first sub-cooler heat exchanger 124, and by passing the third flash gas stream 158 through and warming said stream in the second sub-cooler heat exchanger 144 and then in the first sub-cooler heat exchanger 124. Thus, the cooling duty for sub-cooling the third LNG stream 136 or portion thereof 142 is provided by warming the third flash gas stream 158 in the second sub-cooler heat exchanger 144 (by indirect heat exchange with the third LNG stream 136 or portion thereof 142), and the cooling duty for sub-cooling the second LNG stream 116 or portion thereof 122 is provided by warming the second flash gas stream 138 and further warming the third flash gas stream 158 in the first sub-cooler heat exchanger 124 (by indirect heat exchange with the second LNG stream 116 or portion thereof 122).

The first and second sub-cooler heat exchangers 124 and 144 may be of any suitable type, and may comprise separate heat exchanger units or different sections of the same unit. In the embodiment depicted in FIG. 1, the first and second sub-cooler heat exchangers 124 and 144 are of the plate and fin type.

As also shown in FIG. 1, in this embodiment the first, second and third flash gas streams are recycled so as to provide additional LNG product.

More specifically, before being recycled, refrigeration is first recovered from the first flash gas stream 118 by warming said stream in a second liquefier heat exchanger 164 and then in a second precooler heat exchanger 166. Likewise, the warmed second and third flash gas streams 140 and 162 exiting the first sub-cooler heat exchanger 124, are further warmed in the second liquefier heat exchanger 164 and then in the second precooler heat exchanger 166 so as to recover additional refrigeration therefrom. Again, the second liquefier heat exchanger 164 and second precooler heat exchanger 166 may be of any suitable type, and may comprise separate heat exchanger units or different sections of the same unit. In the embodiment depicted in FIG. 1, they are separate plate and fin heat exchanger units.

The warmed first, second and third flash gas streams 172, 170 and 168, exiting the second precooler heat exchanger 166 are then combined and compressed in a multi-stage compressor 174 with interstage cooling, so as to form a recycle gas stream 176. If desired of necessary, a portion of one or more of the flash gas streams can also be withdrawn and used as a fuel gas (not shown), said fuel gas stream being taken, preferably, from one or more of the warmed flash gas streams 168, 170 or 172. As shown in FIG. 1, where a separate storage tank 192 for storing the LNG product 156 is used, the boil-off gas 194 from the LNG storage tank 192 may also be recycled, in which case the boil-off gas 194 may, for example, be compressed in a separate compressor 195, which likewise may be an multistage compressor with intercoolers (not shown) and an aftercooler 197, to form a compressed boil-off gas 198 that is combined with the compressed flash gas to form the recycle gas stream 176.

The recycle gas stream 176 is then cooled in the first precooler heat exchanger 102, separately from and in parallel with the natural gas feed stream 100, to provide a cooled recycle gas stream 178 at a similar temperature to the cooled natural gas feed stream 104. Next, the cooled recycle gas stream 178 is divided with one portion 182 of the cooled recycle gas being further cooled and liquefied in the first liquefier heat exchanger 106 to provide a liquefied recycle gas stream 186, and another portion being further cooled and liquefied in the second liquefier heat exchanger 164 to provide another liquefied recycle gas stream 184.

Finally, the liquefied recycle gas streams 186 and 184 are expanded to further cool and partially vaporize the streams, and the resulting vapor and liquid phases are separated to provide additional vapor and liquid for forming, respectively, the first flash gas stream 118 and second LNG stream 116. In the arrangement shown in FIG. 1, this is achieved by throttling the liquefied recycle gas streams 186 and 184 through J-T valves 190 and 188, respectively, into the first phase separation vessel 114 into which the first LNG stream is also throttled, as described above.

In the embodiment shown in FIG. 1, the all the cooling duty for precooling the natural gas feed stream 100 and recycle gas stream 176 in the first precooler heat exchanger 102, and all the cooling duty for liquefying the cooled natural gas feed stream 104 and portion 182 of the cooled recycle gas stream in the first liquefier heat exchanger 106 is provided by a methane or treated natural gas refrigerant circulating as gaseous refrigerant in a closed-loop gaseous expander cycle within a closed-loop refrigeration circuit.

The depicted closed-loop gaseous expander cycle involves two stages of expansion. The warm gaseous refrigerant 103, which is typically at a relatively low pressure (such between 10 to 20 bar) is first compressed in a low pressure refrigerant compressor 105 and cooled in associated intercoolers (not shown) and/or aftercooler 107 (typically against an ambient temperature heat sink such as air or water at ambient temperature). The resulting compressed gaseous refrigerant stream 109 is split into two streams 113 and 111 and that are then further compressed in high pressure refrigerant compressors 117 and 115, and the resulting further compressed gaseous refrigerant streams 121 and 119 are then recombined (stream 123) and cooled in an aftercooler 125 (again typically against an ambient temperature heat sink). The resulting cooled and compressed gaseous refrigerant stream 127 is then divided into two streams 129 and 139.

One of the compressed gaseous refrigerant stream 129 is work expanded in a turbo-expander 131, that drives refrigerant compressor 115, to provide a first cold gaseous refrigerant stream 137 that is then warmed in the second precooler heat exchanger 166, separately from and in parallel with the flash gas streams.

The other compressed gaseous refrigerant stream 139 is further cooled in the second precooler heat exchanger, by indirect heat exchange with the flash gas streams and the first cold gaseous refrigerant stream 137, to form a further cooled compressed gaseous refrigerant stream 145. This stream 145 is then work expanded in a turbo-expander 133, that drives refrigerant compressor 117, to provide a second cold gaseous refrigerant stream 135, which is at a colder temperature than the first cold gaseous refrigerant stream 137. The second cold gaseous refrigerant stream 135 is then warmed in the first liquefier heat exchanger 106. The warmed gaseous refrigerant stream 141 exiting the first liquefier heat exchanger 106 is then all further warmed in the first precooler heat exchanger 102, or it may be divided so that one part is further warmed in the first precooler heat exchanger 102 while another part 143 is combined with the first cold gaseous refrigerant stream 137 and further warmed in the second precooler heat exchanger 166.

Finally, the warmed refrigerant streams 101 and 145 exiting the second precooler heat exchanger 166 and the first precooler heat exchanger 102 are combined and returned to the low pressure refrigerant compressor 105 to start again the cycle.

Thus, in the arrangement shown in FIG. 1, all the cooling duty for precooling the natural gas feed stream 100 and recycle gas stream 176 in the first precooler heat exchanger 102, for liquefying the cooled natural gas feed stream 104, and for liquefying part 182 of the cooled recycle gas stream is, as noted above, provided by the methane or natural gas refrigerant in the gaseous expander cycle. The refrigeration for subcooling the LNG is provided flashing the LNG and by recovering refrigerant from the flash gases, further refrigeration being recovered from the flash gases in order to provide the cooling duty for liquefying the remainder of the cooled recycle gas, and for cooling one part of the compressed methane or natural gas refrigerant circulating in the gaseous expander cycle. The relative proportions of the cooled recycle gas stream 178 sent to the first and second liquefier heat exchangers 106 and 164, and the division of the methane/natural gas refrigerant 141 between the first precooler heat exchanger 102 and second precooler heat exchanger 166, are set and/or adjusted as necessary in order to best balance and meet the cooling duty requirements of each of said heat exchangers.

In the arrangement shown in FIG. 1, the use of a separate circuit in the first precooler heat exchanger 102 and first and second liquefier heat exchangers 106 and 164 for cooling and liquefying the recycle gas stream 176 in parallel with but separately from the natural gas feed stream 100 means that the recycle gas stream can be cooled and liquefied at a different pressure from the natural gas feed stream, adding flexibility to the design and operation of the process. In addition, if by chance (e.g. due to bad performance of the pretreatment systems) the original feed gas contains components that could freeze in the temperature range of the heat exchangers, such as water, $CO_2$, and/or heavy hydrocarbons, these components will be only contained in the high pressure tube circuits in the precooler and first liquefier heat exchangers 102 and 106, which as noted above are preferably coil wound heat exchangers which thus provide additional protection for leakage.

Various modifications can be made to the method and system depicted in FIG. 1, as are illustrated by the further embodiments depicted in FIGS. 3 to 10.

Figure 3:
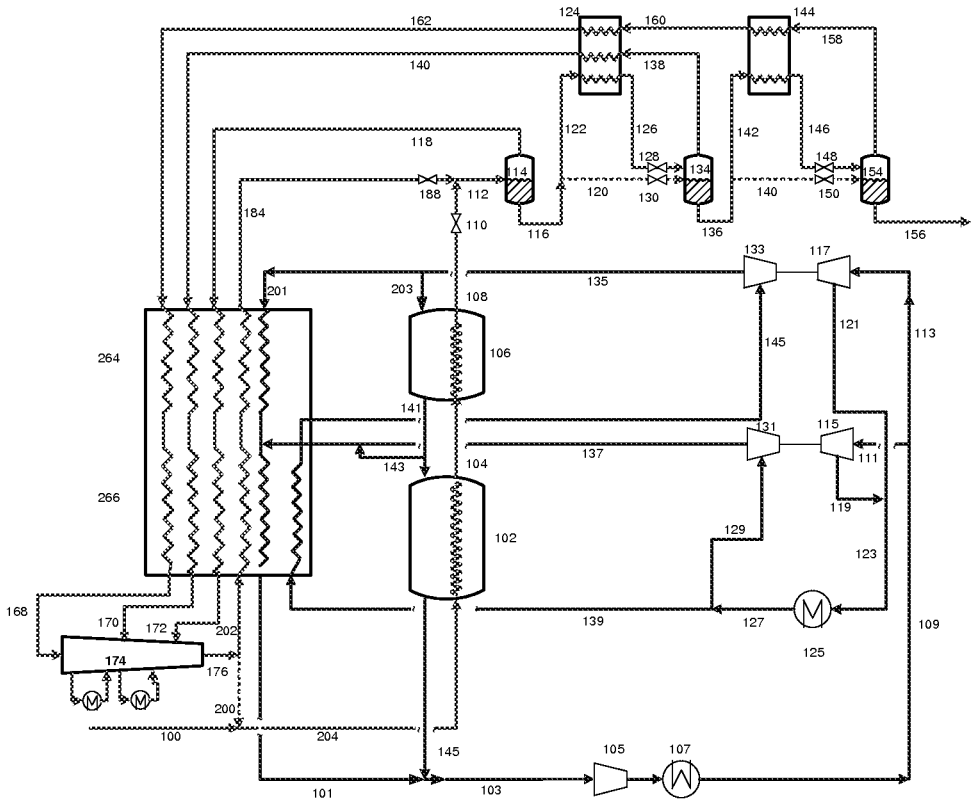
FIG. 3 is a schematic flow diagram depicting a natural gas liquefaction method and system in accordance with another embodiment of the present invention.

The embodiment shown in FIG. 3 differs from that shown in FIG. 1, in that the second liquefier heat exchanger 264 and second precooler heat exchanger 266 are sections of a single plate and fin heat exchanger unit, the second liquefier heat exchanger 264 being located at the colder end of the unit and the second precooler heat exchanger 266 being located at the warmer end of the unit. Additionally, in this embodiment the recycle gas stream 176, 202 is precooled in the second precooler heat exchanger 266, not in the first precooler heat exchanger 102, and all of the cooled recycle gas stream is liquefied in the second liquefier heat exchanger 264, as opposed to part of the cooled recycle gas stream being liquefied in the first liquefier heat exchanger 106, so as to provide a single liquefied recycle gas stream 184 that is then expanded and separated as before to provide additional vapor and liquid for forming, respectively, the first flash gas stream 118 and second LNG stream 116.

In order to balance and meet the resulting cooling duty requirements of the various heat exchangers, in this embodiment the arrangement of the gaseous closed-loop refrigeration circuit and cycle is also modified, so that in this embodiment the second cold gaseous refrigerant stream 135 is divided, with one portion of this stream 201 being then sent to and warmed in the second liquefier heat exchanger 264 and then combined with first cold gaseous refrigerant stream 137 and further warmed in the second precooler heat exchanger 266 (to meet the increased cooling duty requirements of these heat exchangers in this embodiment). The remainder 203 of the second cold gaseous refrigerant stream 135 is sent to and is warmed in the first liquefier heat exchanger 106 and then further warmed in the first precooler heat exchanger 102 (which heat exchangers have, in this embodiment, reduced cooling duty requirements).

Furthermore, as is shown in FIG. 3, the initially produced recycle gas stream 176 may, if desired, be divided to form two recycle gas streams 202 and 200, one of which (202) is precooled and liquefied in the second precooler heat exchanger 266 and second liquefier heat exchanger 264 to provide a liquefied recycle gas stream 184, as noted above, and the other of which (200) is instead added to the natural gas feed stream 100 prior to said stream 204 being precooled and liquefied in the first precooler heat exchanger 102 and first liquefier heat exchanger 106.

This embodiment, like the embodiment depicted in FIG. 1, has the benefit that the natural gas feed stream is cooled and liquefied only in the first precooler heat exchanger 102 and first liquefier heat exchanger 106, thereby providing additional protection in the event that the feed contains freezibles. The efficiency of this embodiment is comparable to the embodiment shown in FIG. 1.

Figure 4:
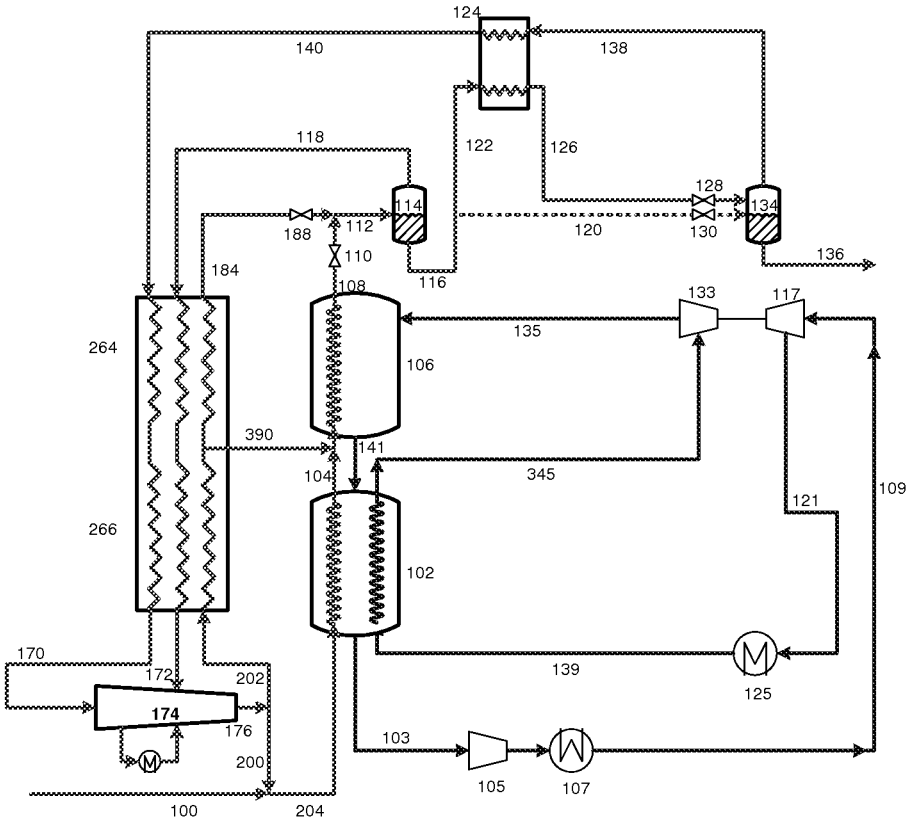
FIG. 4 is a schematic flow diagram depicting a natural gas liquefaction method and system in accordance with another embodiment of the present invention.

In the embodiment shown in FIG. 4, the second liquefier heat exchanger 264 and second precooler heat exchanger 266 are again sections of a single plate and fin heat exchanger unit 267. The embodiment shown in FIG. 4 also differs from that shown in FIG. 1 in that it uses only two end flash stages for further cooling the LNG, and in that the closed-loop gaseous expander cycle involves only one stage of expansion, with the gaseous expander cycle providing all the cooling duty in the first precooler heat exchanger 102 and first liquefier heat exchanger 106, and the first and second flash gas streams 118 and 140 providing all the cooling duty in the second precooler heat exchanger 266 and second liquefier heat exchanger 264.

Thus, in this embodiment the second sub-cooler heat exchanger, third phase separation vessel and associated J-T valves are no longer present or used, and the third LNG stream 136 exiting the second phase separation vessel 134 is not expanded and separated to form a third flash gas stream and fourth LNG stream, but constitutes instead the LNG product. Equally, as the third flash gas stream is no longer present, the second flash gas stream 138 is the only stream that is warmed in the first sub-cooler heat exchanger 124 and thus provides all the cooling duty for said heat exchanger.

In the closed-loop gaseous expander cycle in this embodiment, the warm gaseous refrigerant 103, is again compressed in the low pressure refrigerant compressor 105 and cooled in associated intercoolers (not shown) and/or aftercooler 107. The resulting compressed gaseous refrigerant stream 109 is in this case not split, all of the stream being instead compressed in high pressure refrigerant compressors 117 that is, in this embodiment, the only high pressure refrigerant compressor. The resulting further compressed gaseous refrigerant stream 121 is cooled in aftercooler 125, and the entirety of the resulting cooled and compressed gaseous refrigerant stream 139 is then further cooled in the precooler heat exchanger 102, in parallel with and separately from the natural gas feed stream 100, to form a further cooled compressed gaseous refrigerant stream 345. This stream 345 is then work expanded in a turbo-expander 133, that is linked with and drives the high pressure refrigerant compressor 117, to provide a cold gaseous refrigerant stream 135. The cold gaseous refrigerant stream 135 is then warmed in the first liquefier heat exchanger 106, and the resulting warmed gaseous refrigerant stream 141 exiting the first liquefier heat exchanger 106 is then further warmed in the first precooler heat exchanger 102. Finally, the warmed refrigerant stream 103 exiting the first precooler heat exchanger 102 is returned to the low pressure refrigerant compressor 105 to start again the cycle.

In order to balance the cooling duty requirements between the first and second precooler heat exchangers 102 and 266 and first and second liquefier heat exchangers 106 and 264, in the embodiment shown in FIG. 4 the recycle gas steam 176 that is produced by multi-stage compressor 174 is divided to form two recycle gas streams 202 and 200. One recycle gas stream 200 is added to the natural gas feed stream 100 prior to said stream 204 being precooled and liquefied in the first precooler heat exchanger 102 and first liquefier heat exchanger 106. The other recycle gas stream 202 is precooled in the second precooler heat exchanger 266 and then further divided to form a two recycle gas streams. One of said recycle gas streams is then further cooled and liquefied in the second liquefier heat exchanger 264 to form a liquefied recycle gas stream 184, that is then expanded and separated (as in the embodiment shown in FIG. 1) so as to provide additional vapor and liquid for forming, respectively, the first flash gas stream 118 and second LNG stream 116. The other of said recycle gas streams 390 is combined with the cooled natural gas stream 104 exiting the first precooler heat exchanger 102, prior to said natural gas stream 104 being further cooled and liquefied in the first liquefier heat exchanger 106.

Figure 2:
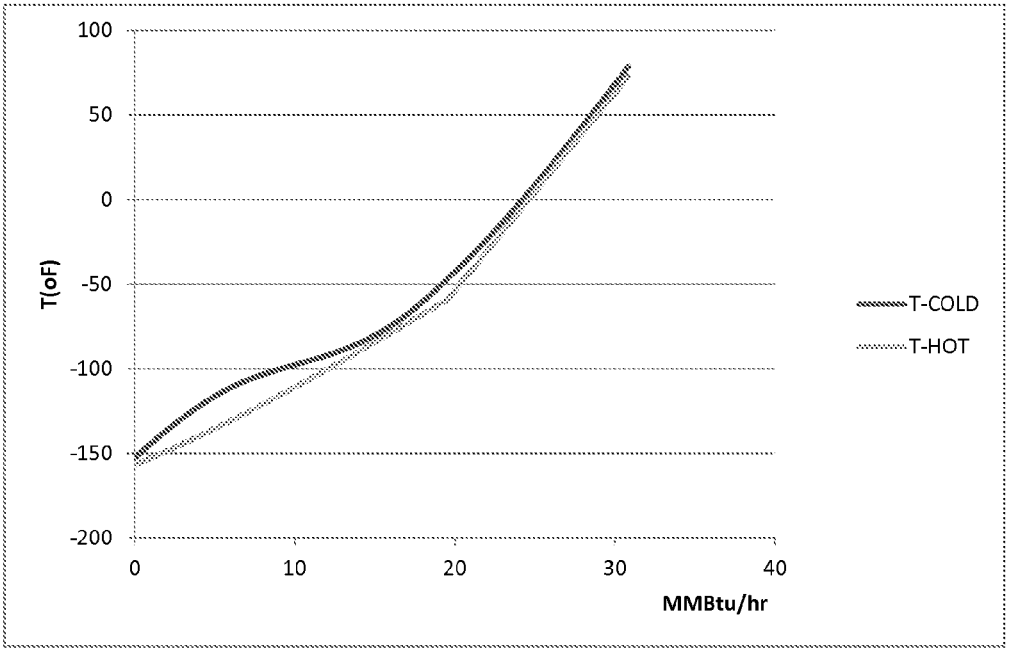
FIG. 2 is a depiction of the cooling curves for the first precooler heat exchanger and first liquefier heat exchanger in the embodiment depicted in FIG. 1.

The embodiment depicted in FIG. 4 is not as efficient as the embodiments depicted in FIGS. 1 and 2, but offers a simpler implementation of invention, requiring less equipment and therefore having a lower capital cost.

Figure 5:
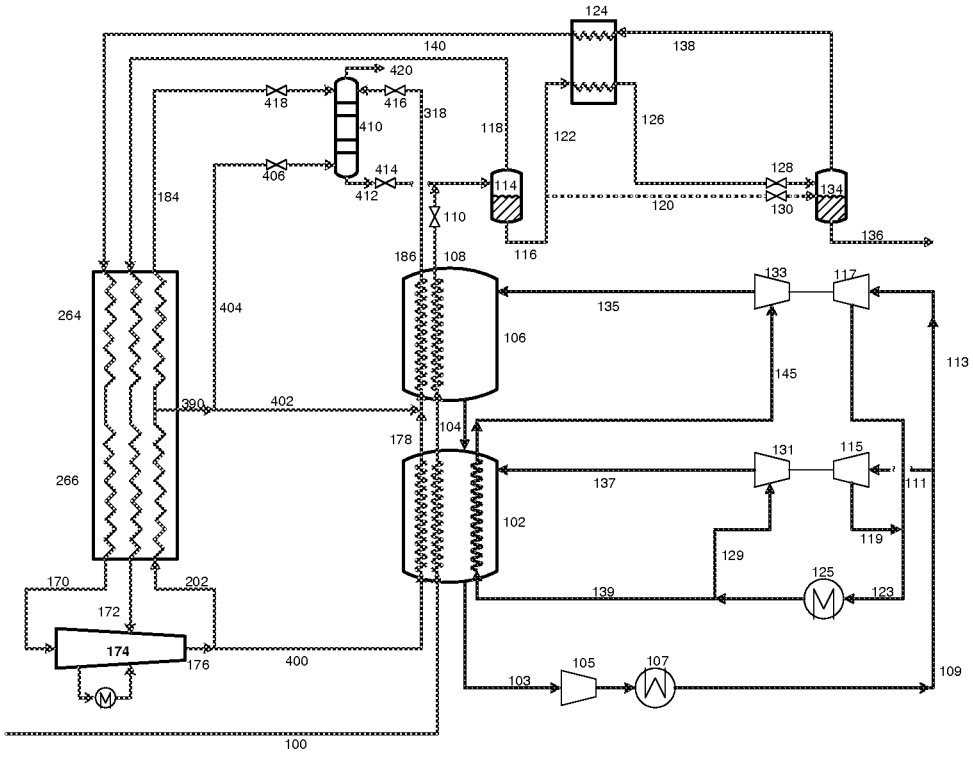
FIG. 5 is a schematic flow diagram depicting a natural gas liquefaction method and system in accordance with another embodiment of the present invention.

FIG. 5 illustrates one possible arrangement for an embodiment in which a distillation column is used to allow rejection of nitrogen and/or other light components from the recycle gas.

The embodiment shown in FIG. 5 uses a closed-loop gaseous expander cycle involving two stages of expansion, as in the embodiment in FIG. 1. However, in this embodiment, the closed-loop gaseous expander only provides cooling duty for the first precooler heat exchanger 102 and first liquefier heat exchanger 106, and the cooling of compressed gaseous refrigerant stream 139 takes place in the first precooler heat exchanger 102 not the second precooler heat exchanger. As compared to the embodiment in FIG. 1, therefore, in this embodiment the cold gaseous refrigerant stream 137 from turbo-expander 131 is sent to and warmed in the first pre-cooler heat exchanger 102, not the second pre-cooler heat exchanger, and the warmed gaseous refrigerant stream exiting the first liquefier heat exchanger 106 is all sent to and further warmed in the first pre-cooler heat exchanger 102.

Like the embodiment shown in FIG. 4, the embodiment in FIG. 5 uses only two stages of end flash for sub-cooling the LNG, and therefore in this embodiment there is no third flash gas stream, and the third LNG stream 136 constitutes the LNG product. Also as in the embodiment shown in FIG. 4, in this embodiment the first and second flash gas streams 118 and 140 provide all the cooling duty in the second precooler heat exchanger 266 and second liquefier heat exchanger 264.

In the embodiment shown in FIG. 5, the recycle gas steam 176 produced by multi-stage compressor 174 is divided to form two recycle gas streams 202 and 400. Recycle gas stream 400 is cooled in the first precooler heat exchanger 102 to form cooled recycle gas stream 178. Recycle gas stream 202 is precooled in the second precooler heat exchanger 266 and then further divided to form three recycle gas streams. One of said recycle gas streams is then further cooled and liquefied in the second liquefier heat exchanger 264 to form a liquefied recycle gas stream 184. Another of said recycle gas streams 390, 402 is combined with the cooled recycle gas stream 178 exiting the first precooler heat exchanger 102, and this combined recycle gas stream is then further cooled and liquefied in the first liquefier heat exchanger 106 to form another liquefied recycle gas stream 186. The other of said recycle gas streams 404 is used as a source of stripping gas, as will be further described below.

The liquefied recycle gas streams 184 and 186 are expanded and partially vaporized, for example by being passed through J-T valves 418 and 416, and introduced into the top of the distillation column 410. The other recycle gas stream 404 is expanded and introduced in the bottom of the distillation column 410, thereby providing stripping gas for the column. The overhead vapor collected at the top of the column, which is enriched (relative to the recycle gas introduced into the distillation column) in nitrogen and/or any other components of the recycle gas that are lighter than methane is withdrawn from the top of the column as a nitrogen (and/or other light component) rich stream 420, that can then be rejected from the system (for example by being flared to atmosphere) or put any desired purpose. The bottoms liquid collected at the bottom of the column, which is depleted (relative to the recycle gas introduced into the distillation column) in nitrogen and/or any other components of the recycle gas that are lighter than methane, is withdrawn from the bottom of the column as a nitrogen (and/or other light component) depleted stream 412. This stream 412 of bottoms liquid is then expanded and separated to produce additional vapor and liquid for forming, respectively, the flash gas stream and second LNG stream. For example, as shown in FIG. 5, the bottoms liquid stream 412 can be expanded by throttling the stream through a J-T valve 414 into the first phase separation vessel 114 into which the first LNG stream 108 is also throttled, as described above.

As noted above, the purpose of the distillation column is to remove nitrogen (and/or other light components) from the recycle gas stream(s) so as to prevent these light components from accumulating in the LNG product. The pressure of the distillation column is optimized to achieve best efficiency. Since the recycled flash streams will contain the majority of nitrogen (and/or any other light components) present in the natural gas feed stream, having a dedicated circuit for re-liquefying the recycled gas streams ensures that nitrogen, and also any other light components (such as $H_2$, He, and/or Ar) present in the natural gas feed, can be removed efficiently and effectively.

Figure 6:
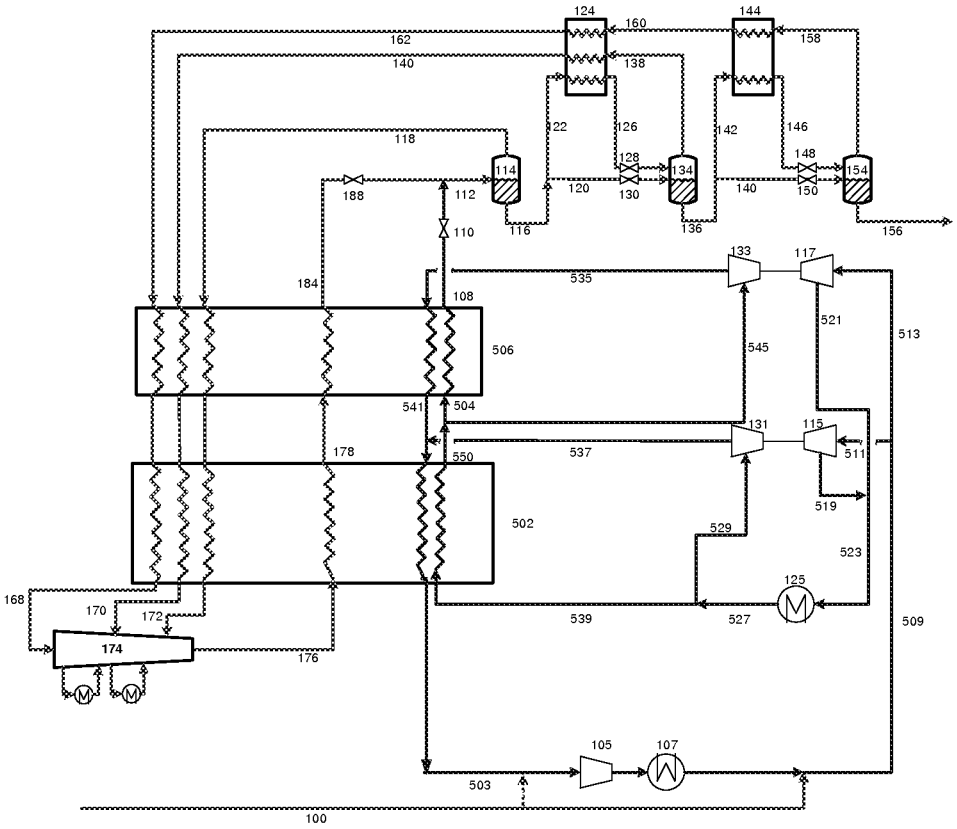
FIG. 6 is a schematic flow diagram depicting a natural gas liquefaction method and system in accordance with another embodiment of the present invention.

The embodiment shown in FIG. 6 differs from the embodiment shown in FIG. 1 in that instead of having a second liquefier heat exchanger and second precooler heat exchanger that receive and recover refrigeration from the flash gas streams, the first precooler heat exchanger 502 and first liquefier heat exchanger 506 are designed to receive also the flash gas streams and recover refrigeration therefrom. In addition, FIG. 6 illustrates the use of an open-loop refrigeration circuit, using treated natural gas refrigerant circulating as gaseous refrigerant in an open-loop gaseous expander cycle, to provide cooling duty to the first precooler heat exchanger and first liquefier heat exchanger. In the embodiment depicted in FIG. 6, the first precooler heat exchanger 502 and the first liquefier heat exchanger 506 are plate and fin heat exchangers, but again any suitable type of heat exchanger may be used.

Thus, in the embodiment shown in FIG. 6, refrigeration is recovered from the first flash gas stream 118, and from the second and third flash gas streams 140 and 162 exiting the first sub-cooler heat exchanger 124, by warming said streams in the first liquefier heat exchanger 506 and first precooler heat exchanger 502. The warmed first, second and third flash gas streams 172, 170 and 168 exiting the first precooler heat exchanger 502 are then combined and compressed in the multi-stage compressor 174 so as to form a recycle gas stream 176. The recycle gas stream 176 is then cooled in the first precooler heat exchanger 102 to provide a cooled recycle gas stream 178, and the cooled recycle gas stream 178 is further cooled and liquefied in the first liquefier heat exchanger 106 to provide the liquefied recycle gas stream 184. The liquefied recycle gas stream 184 is then expanded to further cool and partially vaporize the stream, and the resulting vapor and liquid phases are separated to provide additional vapor and liquid for forming, respectively, the first flash gas stream 118 and second LNG stream 116 (as described above in relation to FIG. 1).

A treated natural gas stream 100 is introduced into in the open-loop refrigeration circuit as a combination of both natural gas feed and make-up refrigerant. The natural gas stream 100 may be introduced into the circuit upstream of the low pressure refrigerant compressor 105, in which case the natural gas stream 100 is combined with the warm refrigerant 503 exiting the precooler heat exchanger 502, and the combined stream is then compressed in low pressure refrigerant compressor 105 and cooled in associated intercoolers (not shown) and/or aftercooler 107 to form a compressed and cooled combined stream 509 of gaseous refrigerant and natural gas feed. Alternatively, the natural gas stream 100 may be introduced into the circuit downstream of the low pressure refrigerant compressor 105, in which case the warm refrigerant 503 exiting the precooler heat exchanger 502 is compressed in low pressure refrigerant compressor 105 and cooled in associated intercoolers (not shown) and/or aftercooler 107 to form a compressed and cooled stream of gaseous refrigerant that is then combined with the natural gas stream 100 to form the compressed and cooled combined stream 509 of gaseous refrigerant and natural gas feed.

The compressed and cooled combined stream 509 is then split into two streams 513 and 511, which are then further compressed in high pressure refrigerant compressors 117 and 115, and the resulting further compressed streams 521 and 519 are then recombined (stream 523) and cooled in aftercooler 125. The resulting cooled and compressed combined stream of gaseous refrigerant and natural gas feed 527 is then divided into two streams 529 and 539.

Stream 529 is work expanded in turbo-expander 131 to provide a first cold gaseous refrigerant stream 537 that is then warmed in the first precooler heat exchanger 502, separately from and in parallel with the flash gas streams.

Stream 539 is further cooled in the first precooler heat exchanger 502, by indirect heat exchange with the flash gas streams and the first cold gaseous refrigerant stream 537, to form a further cooled and compressed gaseous stream 550. This stream 550 is divided to form separate refrigerant 545 and natural gas feed 541 streams. The (now cooled) natural gas feed stream 541 is further cooled and liquefied in the first liquefier heat exchanger 506 to provide the first LNG stream 108 that is then further processed as described in FIG. 1. The cooled gaseous refrigerant stream 545 is work expanded in turbo-expander 133 to form a second cold gaseous refrigerant stream 535. This stream 535 is then warmed in the first liquefier heat exchanger 506, separately from and in parallel with the flash gas. The warmed gaseous refrigerant stream 541 exiting the first liquefier heat exchanger 106 is combined with the cold refrigerant stream 537 and further warmed in the first precooler heat exchanger 502.

Finally, the warmed refrigerant stream 503 exiting the first precooler heat exchanger 502 is returned to the low pressure refrigerant compressor 105 to start again the cycle.

Figure 7:
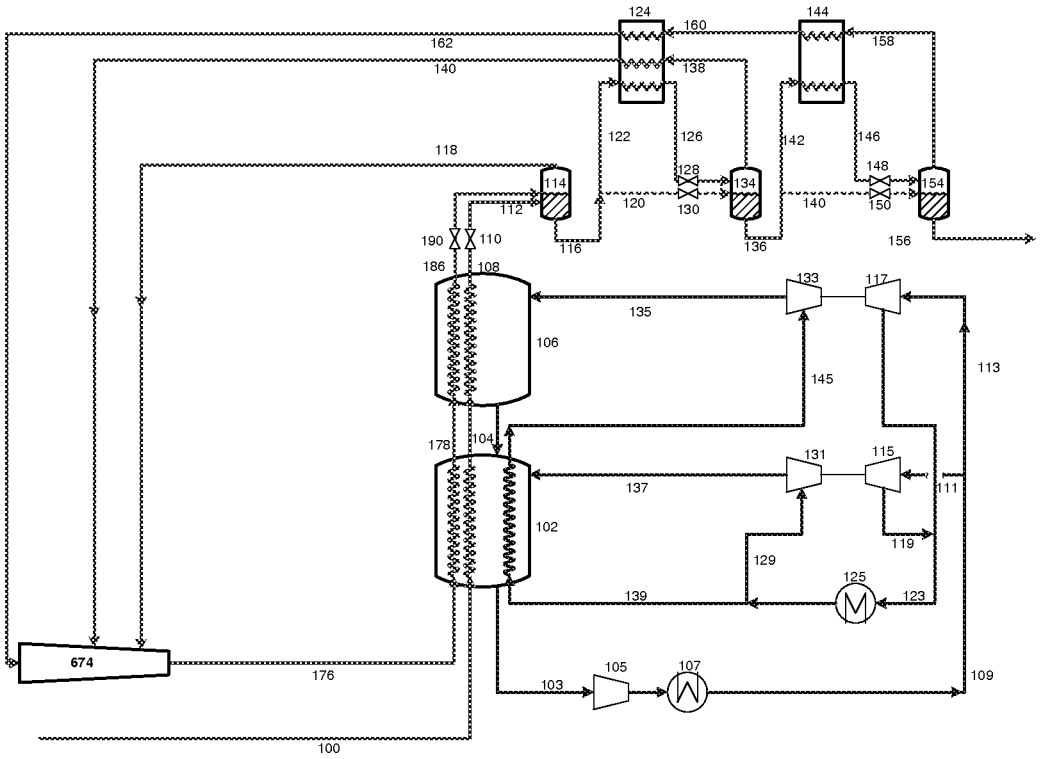
FIG. 7 is a schematic flow diagram depicting a natural gas liquefaction method and system in accordance with another embodiment of the present invention.

FIG. 7 illustrates a further embodiment of the invention, in which the second precooler heat exchanger and second liquefier heat exchanger are again omitted. In this embodiment, refrigeration is not recovered from the first flash gas stream 118 in a heat exchanger, nor is further refrigeration recovered from the, already partially warmed, second and third flash gas streams 140 and 162 exiting the first sub-cooler heat exchanger 124. Instead, these flash gas streams are fed directly to and cold compressed in compressor 674, which in this case does not require the use of inter- or after-coolers, so as to form the recycle gas stream 176. The recycle gas stream 176 is then cooled in the first precooler heat exchanger and further cooled and liquefied in the first liquefier heat exchanger 106, in parallel with and separately from the natural gas feed stream, so as to provide a liquefied recycle stream 186 that is then expanded and separated to provide additional vapor and liquid for forming, respectively, the first flash gas stream 118 and second LNG stream 116, as previously discussed. The operation of the closed-loop gaseous expander cycle in this embodiment is the same as that described above in relation to FIG. 5.

Figure 8:
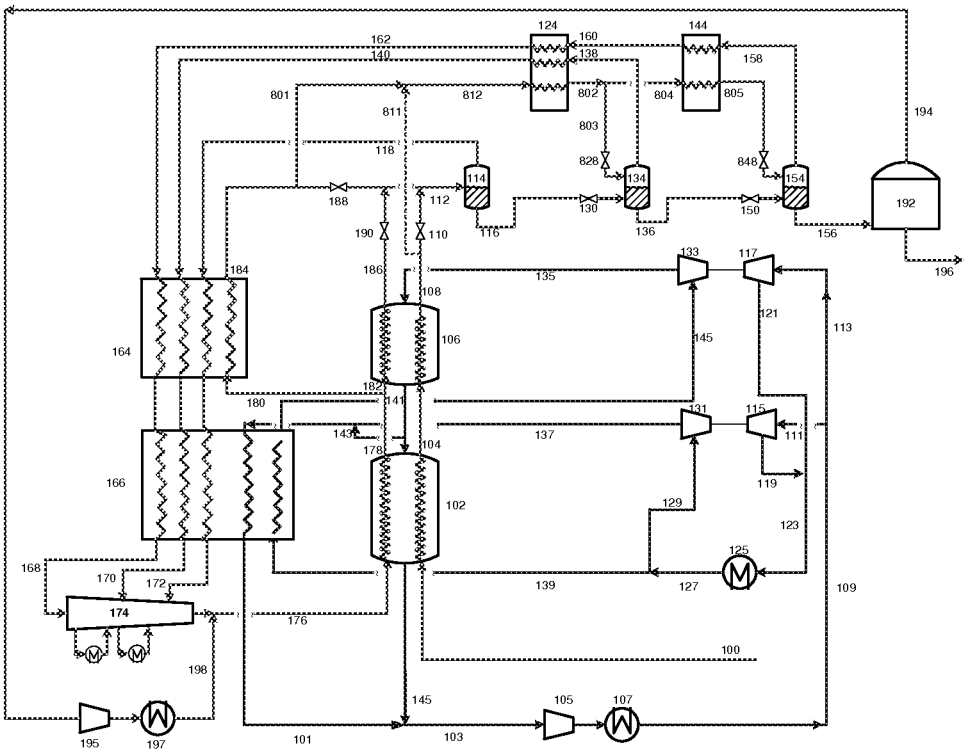
FIG. 8 is a schematic flow diagram depicting a natural gas liquefaction method and system in accordance with another embodiment of the present invention.

FIG. 8 shows another embodiment of the present invention, which differs from the embodiment depicted in FIG. 1 in that in this embodiment the first and second sub-cooler heat exchangers 124 and 144 are not used to sub-cool a portion or all of the second and third LNG streams 116 and 136, but are instead used to subcool first 812 and second 804 supplementary LNG streams.

More specifically, in this embodiment the first phase separation vessel 114 again receives the expanded and partially vaporized first LNG stream and expanded and partially vaporized liquefied recycle gas streams and separates the resulting vapor and liquid phases to provide the first flash gas stream 118 and second LNG stream 116. In this embodiment, however, all of the second LNG stream 116 is expanded and partially vaporized, for example by being throttled through a J-T valve 130, and sent to the second phase separation vessel 134 without any portion of the stream being first sub-cooled in the first sub-cooler heat exchanger. Similarly, all of the third LNG stream 116 is expanded and partially vaporized, for example by being throttled through a J-T valve 150, and sent to the third phase separation vessel 154 without any portion of the stream being first sub-cooled in the second sub-cooler heat exchanger.

The first and second sub-cooler heat exchangers 124 and 144 still receive and recover refrigeration from the second and third flash gas streams 138 and 158, as described above in relation to FIG. 1. However, the first sub-cooler heat exchanger 124 in this embodiment sub-cools a first supplementary LNG stream 812. The resulting sub-cooled first supplementary LNG stream 802 is, in this embodiment, then divided into two portions. One portion, stream 803, is expanded, partially vaporized and separated to provide additional vapor and liquid for forming respectively, the second flash gas stream 138 and third LNG stream 136, which may for example be achieved by throttling said portion 803 of the sub-cooled first supplementary LNG stream through a J-T valve 828 into the second phase separation vessel 134. The other portion of the sub-cooled first supplementary LNG stream 802 forms a second supplementary LNG stream 804 that is then sub-cooled in the second sub-cooler heat exchanger 144. The resulting sub-cooled second supplementary LNG stream 805 is then expanded, partially vaporized and separated to provide additional vapor and liquid for forming respectively, the third flash gas stream 158 and fourth LNG stream 156, which may for example be achieved by throttling the sub-cooled second supplementary LNG stream 805 through a J-T valve 848 into the third phase separation vessel 154.

The first supplementary LNG stream 812 can, in this embodiment derive from a variety of sources. The first supplementary LNG stream 812 can, for example, comprise a stream of liquefied recycle gas 801 formed from a portion (or all) of the liquefied recycle gas 184 generated by the second liquefier heat exchanger 164 (as shown in FIG. 8), or from a portion or all of the liquefied recycle gas 186 generated by the first liquefier heat exchanger (not shown), with the remainder of said liquefied recycle gas streams being expanded and sent to the first phase separator 114, as previously described. Alternatively or additionally, the first supplementary LNG stream 812 can comprise a portion 811 of the LNG stream 108 that is generated by the first liquefier heat exchanger from liquefying the natural gas feed stream, with the remainder of said LNG stream 108 forming first LNG stream that is then expanded and sent to the first phase separator 114, as previously described.

Figure 9:
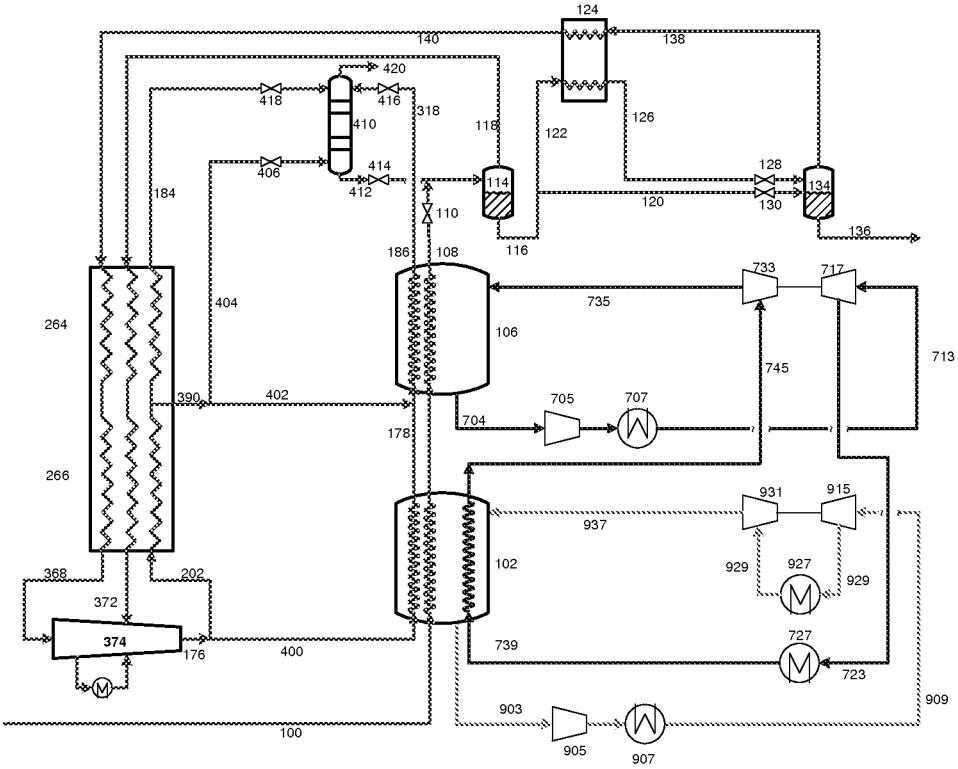
FIG. 9 is a schematic flow diagram depicting a natural gas liquefaction method and system in accordance with another embodiment of the present invention.
Figure 10:
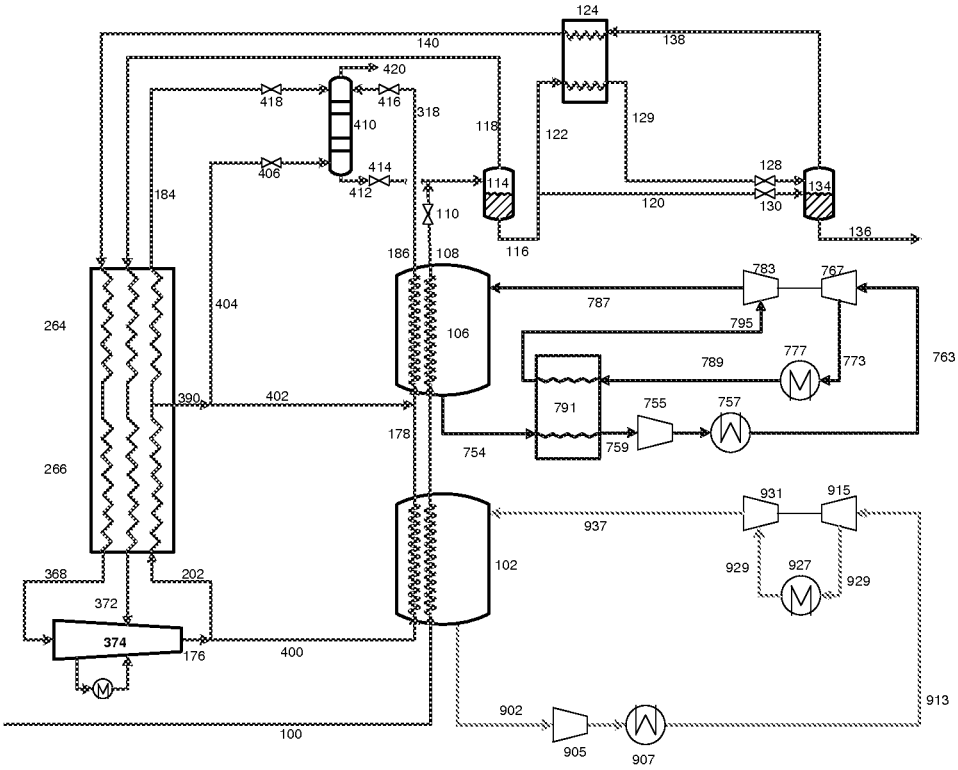
FIG. 10 is a schematic flow diagram depicting a natural gas liquefaction method and system in accordance with another embodiment of the present invention.

FIGS. 9 and 10 illustrate yet further embodiments on the invention, which differ from the previous embodiments in terms of the manner in which refrigerant is provided for the first precooler heat exchanger 102 (all other aspects of these embodiments being the same as the embodiment shown in FIG. 5 and described above). More specifically, in both of these embodiments the cooling duty for the first precooler heat exchanger 102 is provided by a closed-loop refrigeration circuit in which an ethylene (or ethane) refrigerant is circulated as gaseous refrigerant in a closed-loop gaseous expander cycle. The gaseous methane or natural gas expander cycle is, in turn, only used to provide the cooling duty for the first liquefier heat exchanger 106.

More specifically, in the embodiment shown in FIG. 9, a warm gaseous ethylene refrigerant 903 exiting the first precooler heat exchanger 102 is compressed in a low pressure ethylene refrigerant compressor 905 and cooled in associated intercoolers (not shown) and/or aftercooler 907. The compressed ethylene refrigerant is further compressed in high pressure ethylene refrigerant compressor 915, cooled in associated intercoolers (not shown) and/or aftercooler 927 and then work expanded in turbo-expander 931, which drives the high pressure ethylene refrigerant compressor 915, so as to produce a cold gaseous ethylene refrigerant stream 937. The cold gaseous ethylene refrigerant stream 937 is then warmed in the first precooler heat exchanger 102 to provide the cooling duty for said heat exchanger. The warm gaseous ethylene refrigerant 903 exiting the first precooler heat exchanger 102 is then returned to the low pressure compressor 905 to restart the gaseous ethylene expander cycle.

The warm gaseous methane or natural gas refrigerant 704 exiting the first liquefier heat exchanger 106 is compressed in a low pressure methane/natural gas refrigerant compressor 705 and cooled associated intercoolers (not shown) and/or aftercooler 707. The resulting compressed refrigerant stream 713 is then further compressed in a high pressure methane/natural gas refrigerant compressor 717 and cooled in associated intercoolers (not shown) and/or aftercooler 727, and the resulting cooled and compressed gaseous refrigerant stream 739 is then further cooled in the first precooler heat exchanger 102 in parallel with and separately from the natural gas feed stream 100. The cold gaseous refrigerant stream 745 exiting the precooler heat exchanger 102 is then work expanded in turbo-expander 733, which drives the high pressure methane/natural gas refrigerant compressor 717, to provide a further cooled gaseous refrigerant stream 735 that is then warmed in the first liquefier heat exchanger 106 to provide the cooling duty for said heat exchanger. The warm gaseous methane or natural gas refrigerant 704 exiting the first liquefier heat exchanger 106 is then returned to the low pressure methane/natural gas refrigerant compressor 705 to restart the gaseous methane or natural gas expander cycle.

In the embodiment shown in FIG. 10, the operation of the gaseous ethylene expander cycle is the same as that depicted in FIG. 9 and described above. However, the gaseous methane or natural gas expander cycle differs from that depicted and FIG. 9, in that in this embodiment the gaseous methane/natural gas refrigerant is not cooled in the first precooler heat exchanger 102.

More specifically, in the embodiment shown in FIG. 10, the warmed gaseous methane or natural gas refrigerant 754 exiting the first liquefier heat exchanger 106 is further warmed in an economizer heat exchanger 791 to provide a warmed gaseous refrigerant stream 759 that is then compressed in a low pressure methane/natural gas refrigerant compressor 755 and cooled associated intercoolers (not shown) and/or aftercooler 757. The resulting compressed refrigerant stream 763 is then further compressed in a high pressure methane/natural gas refrigerant compressor 767 and cooled in associated intercoolers (not shown) and/or aftercooler 777. The resulting cooled and compressed gaseous refrigerant stream 789 is then further cooled in the economizer heat exchanger 791. The cold gaseous refrigerant stream 795 exiting the economizer heat exchanger 791 is then work expanded in turbo-expander 783, which drives the high pressure methane/natural gas refrigerant compressor 767, to provide a further cooled gaseous refrigerant stream 787 that is then warmed in the first liquefier heat exchanger 106 to provide the cooling duty for said heat exchanger. The warmed gaseous methane or natural gas refrigerant 754 exiting the first liquefier heat exchanger 106 is then returned to the economizer heat exchanger 791 to restart the cycle.

EXAMPLE

In order to illustrate the operation of the invention, the method of liquefying a natural gas feed stream described and depicted in FIG. 1 was simulated, using ASPEN Plus software. The simulation was conducted on the basis of a natural gas feed stream that comprised 100% methane and a gaseous refrigerant that comprised 100% methane also.

Table 1 below lists the conditions and compositions of various streams during the simulation (the reference numerals used in Table 1 being the same as those used in FIG. 1). In this simulation, the total specific power of the process is minimized by controlling parameters such as the pressure of each stage of flash, the outlet temperature of each heat exchanger, the split ratio of each stream that is split or divided, and the outlet pressure of each expander, as is known in the art.

Table 2 shows a comparison between method of FIG. 1, simulated as described above, and the state of the art three-compander nitrogen recycle process, where "UA" equals the overall required heat transfer coefficient multiplied by the contact area. The comparison was conducted using the same feed gas conditions. As can be seen from Table 2, the method according to the present invention provides higher efficiency and consumes less power than the traditional nitrogen recycle process.

FIG. 2 shows the cooling curves for the first precooler heat exchanger 102 and first liquefier heat exchanger 106.

TABLE 1

| | Stream | | | | | | | |
|---|---|---|---|---|---|---|---|---|
| | 100 | 104 | 108 | 116 | 118 | 120 | 122 | 126 |
| Temperature (° F.) | 78.8 | −47.0 | −153.1 | −182.5 | −182.5 | −182.5 | −182.5 | −219.6 |
| Pressure (psia) | 993.5 | 943.5 | 923.5 | 180.1 | 180.1 | 180.1 | 180.1 | 176.1 |
| Vapor Fraction | 1.0 | 1.0 | 0.0 | 0 | 1.0 | 0.0 | 0.0 | 0.0 |
| Total Flow (lbmol/hr) | 4750.1 | 4750.1 | 4750.1 | 6701.4 | 1199.1 | 5655.1 | 1046.2 | 1046.2 |

| | Stream | | | | | | | |
|---|---|---|---|---|---|---|---|---|
| | 136 | 138 | 140 | 146 | 156 | 158 | 194 | 196 |
| Temperature (° F.) | −222.9 | −222.9 | −222.9 | −250.5 | −254.2 | −254.2 | −256.6 | −256.6 |
| Pressure (psia) | 58.5 | 58.5 | 58.5 | 54.5 | 18.0 | 18.0 | 16.1 | 16.1 |
| Vapor Fraction | 0.0 | 1.0 | 0.0 | 0.0 | 0.0 | 1.0 | 1.0 | 0.0 |
| Total Flow (lbmol/hr) | 5624.1 | 1077.3 | 5217.2 | 406.9 | 4750.1 | 648.3 | 225.8 | 4750.1 |

| | Stream | | | | | | | |
|---|---|---|---|---|---|---|---|---|
| | 168 | 170 | 172 | 176 | 180 | 182 | 184 | 186 |
| Temperature (° F.) | 72.8 | 72.8 | 72.8 | 78.7 | −47.0 | −47.0 | −182.5 | −153.1 |
| Pressure (psia) | 14.5 | 56.0 | 178.1 | 958.4 | 908.4 | 908.4 | 906.4 | 858.4 |
| Vapor Fraction | 1.0 | 1.0 | 1.0 | 1.0 | 1.0 | 1.0 | 0.0 | 0.0 |
| Total Flow (lbmol/hr) | 648.3 | 1077.3 | 1199.1 | 3150.4 | 979.5 | 2170.9 | 979.5 | 2170.9 |

| | Stream | | | | | | | |
|---|---|---|---|---|---|---|---|---|
| | 103 | 109 | 127 | 129 | 137 | 145 | 135 | 143 |
| Temperature (° F.) | 72.6 | 78.8 | 78.8 | 78.8 | −54.6 | −47.0 | −157.1 | −59.3 |
| Pressure (psia) | 264.3 | 552.2 | 894.2 | 894.2 | 270.3 | 892.2 | 276.3 | 270.3 |
| Vapor Fraction | 1.0 | 1.0 | 1.0 | 1.0 | 1.0 | 1.0 | 1.0 | 1.0 |
| Total Flow (lbmol/hr) | 30304 | 30304 | 30304 | 11247 | 11247 | 19057 | 19057 | 9495 |

TABLE 2

| | Present invention | 3-compander Nitrogen recycle process |
|---|---|---|
| Relative specific power | 0.93 | 1 |
| Relative UA | 0.93 | 1 |

It will be appreciated that the invention is not restricted to the details described above with reference to the preferred embodiments but that numerous modifications and variations can be made without departing from the spirit or scope of the invention as defined in the following claims.

The invention claimed is:

1. A method of liquefying a natural gas feed stream to produce a liquefied natural gas (LNG) product, the method comprising:

(a) liquefying the natural gas feed stream, by indirect heat exchange with a methane or natural gas refrigerant circulating as gaseous refrigerant in a gaseous expander cycle, to produce a first LNG stream;

(b) expanding the first LNG stream to further cool and partially vaporize the first LNG stream, and separating the resulting vapor and liquid phases to produce a first flash gas stream and a second LNG stream;

(c) expanding the second LNG stream to further cool and partially vaporize the second LNG stream, and separating the resulting vapor and liquid phases to produce a second flash gas stream and a third LNG stream, the LNG product comprising the third LNG stream or a portion thereof; and (d) recovering refrigeration from the second flash gas stream by using the second flash gas stream to sub-cool, by indirect heat exchange a first supplementary LNG stream, at least a portion of which is then expanded and separated to produce additional vapor and liquid for forming, respectively, the second flash gas stream and the third LNG stream.

2. The method of claim 1, wherein the method further comprises:

(e) expanding the third LNG stream to further cool and partially vaporize the third LNG stream, and separating the resulting vapor and liquid phases to produce a third flash gas stream and a fourth LNG stream, the LNG product comprising the fourth LNG stream or a portion thereof; and (f) recovering refrigeration from the third flash gas stream by using the third flash gas stream to sub-cool, by indirect heat exchange a second supplementary LNG stream, formed from a sub-cooled portion of the first supplementary LNG stream, at least a portion of which is then expanded and separated to produce additional vapor and liquid for forming, respectively, the third flash gas stream and the fourth LNG stream.

3. The method of claim 2, wherein step (d) comprises sub-cooling the first supplementary LNG stream by indirect heat exchange with both the second flash gas stream and the third flash gas stream.

4. The method of claim 1, wherein the method further comprises recycling at least a portion of one or more of the flash gas streams by:

compressing said at least a portion of the flash gas stream(s) so as to form one or more recycle gas streams; and liquefying one or more of said one or more recycle gas streams to produce one or more liquefied recycle streams.

5. The method of claim 4, wherein the recycle gas stream(s) are liquefied: by indirect heat exchange with the methane or natural gas refrigerant circulating as gaseous refrigerant in a gaseous expander cycle; and/or by indirect heat exchange with at least a portion of one or more of the flash gas streams.

6. The method of claim 5, wherein the methane or natural gas refrigerant and/or at least a portion of one or more of the flash gas streams provide all of the cooling duty for liquefying the recycle gas stream(s).

7. The method of claim 4, wherein the method further comprises expanding and separating one or more of said one or more liquefied recycle streams to produce additional vapor and liquid for forming, respectively, the first flash gas stream and second LNG stream.

8. The method of claim 4, wherein step (d) comprises sub-cooling, expanding and separating the first supplementary LNG stream in accordance with step (d), and wherein the first supplementary LNG stream comprises one or more of said one or more liquefied recycle streams.

9. The method of claim 1, wherein at least a portion of methane or natural gas refrigerant circulating as gaseous refrigerant in the gaseous expander cycle is cooled, prior to being expanded to form cold gaseous refrigerant that is used in step (a) for liquefying the natural gas feed stream, by indirect heat exchange with at least a portion of one or more of the flash gas streams.

10. The method of claim 1, wherein the methane or natural gas refrigerant circulates as gaseous refrigerant in a closed-loop gaseous expander cycle.

11. A system for liquefying a natural gas feed stream to produce a liquefied natural gas (LNG) product, the system comprising:

a first liquefier heat exchanger arranged and operable to receive the natural gas feed stream and a methane or natural gas refrigerant, and to liquefy the natural gas feed stream, by indirect heat exchange with the methane or natural gas refrigerant, to produce a first LNG stream;

a refrigeration circuit arranged and operable to circulate the methane or natural gas refrigerant as gaseous refrigerant in a gaseous expander cycle, the refrigeration circuit being connected to the first liquefier heat exchanger so as to pass the circulating gaseous refrigerant through the first liquefier heat exchanger;

a pressure reduction device and phase separation vessel arranged and operable to receive the first LNG stream, expand the first LNG stream so as to further cool and partially vaporize said stream, and separate the resulting vapor and liquid phases to produce a first flash gas stream and a second LNG stream;

a pressure reduction device and phase separation vessel arranged and operable to receive the second LNG stream, expand the second LNG stream so as to further cool and partially vaporize said stream, and separate the resulting vapor and liquid phases to produce a second flash gas stream and a third LNG stream, the LNG product comprising the third LNG stream or a portion thereof; and a first sub-cooler heat exchanger arranged and operable to receive the second flash gas stream and recover refrigeration therefrom, the first sub-cooler heat exchanger being further arranged and operable to receive and sub-cool, by indirect heat exchange with the second flash gas stream, a first supplementary LNG stream, prior to at least a portion of said stream being received by a pressure reduction device and phase separation vessel arranged and operable to expand and separate said at least a portion of the first supplementary LNG stream so to produce additional vapor and liquid for forming, respectively, the second flash gas stream and third LNG stream.

12. A system according to claim 11, wherein the first sub-cooler heat exchanger is arranged and operable to receive the second flash gas stream and at least a portion of the second LNG stream, and to sub-cool said at least a portion of the second LNG stream, by indirect heat exchange with the second flash gas stream, prior to said second LNG stream being received by the pressure reduction device arranged and operable to expand said stream.

13. A system according to claim 11, wherein the first liquefier heat exchanger is arranged such that in operation the only refrigerant that it receives is either the methane or natural gas refrigerant, or the methane or natural gas refrigerant and the at least a portion of one or more of the flash gas streams, so that in operation the methane or natural gas refrigerant, or the methane or natural gas refrigerant and the at least a portion of one or more of the flash gas streams, provides all of the cooling duty for liquefying the natural gas feed stream.

14. A system according to claim 11, wherein the system further comprises:

a pressure reduction device and phase separation vessel arranged and operable to receive the third LNG stream, expand the third LNG stream so as to further cool and partially vaporize said stream, and separate the resulting vapor and liquid phases to produce a third flash gas stream and a fourth LNG stream, the LNG product comprising the fourth LNG stream or a portion thereof; and a second sub-cooler heat exchanger arranged and operable to receive the third flash gas stream and recover refrigeration therefrom, the second sub-cooler heat exchanger being further arranged and operable to receive and sub-cool, by indirect heat exchange with the second flash gas stream, a second supplementary LNG stream, formed from a sub-cooled portion of the first supplementary LNG stream, prior to at least a portion of said second supplementary LNG stream being received by a pressure reduction device and phase separation vessel arranged and operable to expand and separate said at least a portion of the second supplementary LNG stream so to produce additional vapor and liquid for forming, respectively, the third flash gas stream and fourth LNG stream.

15. A system according to claim 14, wherein the second sub-cooler heat exchanger is arranged and operable to receive the third flash gas stream and at least a portion of the third LNG stream, and to sub-cool said at least a portion of the third LNG stream, by indirect heat exchange with the third flash gas stream, prior to said third LNG stream being received by the pressure reduction device arranged and operable to expand said stream.

16. A system according to claim 14, wherein the first sub-cooler heat exchanger is arranged and operable to receive also the third flash gas stream and to sub-cool the at least a portion of the second LNG stream and/or the first supplementary LNG stream by indirect heat exchange with both the second flash gas stream and the third flash gas stream.

17. A system according to claim 11, wherein the system further comprises one or more compressors arranged and operable to receive and compress at least a portion of one or more of the flash gas streams, so as to form one or more recycle gas streams.

18. A system according to claim 17, wherein the system further comprises a second liquefier heat exchanger arranged and operable to receive one or more of said one or more recycle gas streams, to receive the methane or natural gas refrigerant and/or at least a portion of one or more of the flash gas streams, and to and liquefy said recycle gas stream(s) by indirect heat exchange with said methane or natural gas refrigerant and/or said flash gas; and/or wherein the first liquefier heat exchanger is arranged and operable to receive one or more of said one or more recycle gas streams, and to liquefy said stream(s) by indirect heat exchange with the methane or natural gas refrigerant.

19. A system according to claim 18, wherein the system further comprises one or more pressure reduction devices arranged and operable to receive and expand one or more of said one or more liquefied recycle gas streams, so as to cool and partially vaporize said stream(s), and to deliver said expanded recycle gas stream(s) into the phase separation vessel that receives and separates the expanded first LNG stream.

20. A system according to claim 18, wherein the system further comprises: one or more pressure reduction devices arranged and operable to receive and expand one or more of said one or more liquefied recycle gas streams, so as to further cool and partially vaporize said stream(s); a distillation column arranged and operable to receive said expanded recycle gas stream(s) and separate said expanded recycle gas stream(s) into a nitrogen-enriched overhead vapor and nitrogen-depleted bottoms liquid; and a pressure reduction device arranged and operable to receive and expand a stream of nitrogen depleted bottoms liquid withdrawn from the distillation column, so as to further cool and partially vaporize said stream, and to deliver said expanded bottoms liquid stream into the phase separation vessel that receives and separates the expanded first LNG stream.

21. A system according to claim 18, wherein the first sub-cooler heat exchanger is arranged and operable receive and sub-cool the first supplementary LNG stream, and wherein the first supplementary LNG stream comprises one or more of said one or more liquefied recycle streams.

22. A system according to claim 17, wherein the one or more compressors that are arranged and operable to compress at least a portion of one or more of the flash gas streams are furthermore arranged and operable to introduce one or more of the one or more recycle gas streams into the natural gas feed stream prior to the natural gas feed stream being received by the first liquefier heat exchanger.

23. A system according to claim 11, wherein the refrigeration circuit arranged and operable to circulate the methane or natural gas refrigerant is a closed-loop circuit.

24. A system according to claim 11, wherein the refrigeration circuit arranged and operable to circulate the methane or natural gas refrigerant is an open-loop circuit.

* * * * *